US010211541B2

(12) United States Patent
Sano et al.

(10) Patent No.: US 10,211,541 B2
(45) Date of Patent: Feb. 19, 2019

(54) ANTENNA DEVICE

(71) Applicant: KABUSHIKI KAISHA TOSHIBA, Minato-ku, Tokyo (JP)

(72) Inventors: Makoto Sano, Kawasaki Kanagawa (JP); Keiju Yamada, Yokohama Kanagawa (JP); Koh Hashimoto, Yokohama Kanagawa (JP); Makoto Higaki, Setagaya Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/691,006

(22) Filed: Aug. 30, 2017

(65) Prior Publication Data

US 2018/0123261 A1 May 3, 2018

(30) Foreign Application Priority Data

Nov. 2, 2016 (JP) ..... 2016-215304

(51) Int. Cl.

| | |
|---|---|
| ***H01Q 1/52*** | (2006.01) |
| ***H01Q 7/00*** | (2006.01) |
| ***H01Q 9/04*** | (2006.01) |
| ***H01Q 9/26*** | (2006.01) |
| ***H01Q 13/08*** | (2006.01) |
| ***H01Q 21/00*** | (2006.01) |

(52) U.S. Cl.

CPC ..... *H01Q 21/0087* (2013.01); *H01Q 1/523* (2013.01); *H01Q 7/00* (2013.01); *H01Q 9/0414* (2013.01); *H01Q 9/0442* (2013.01); *H01Q 9/265* (2013.01); *H01Q 21/0006* (2013.01); *H01Q 13/08* (2013.01)

(58) Field of Classification Search

None

See application file for complete search history.

(56) References Cited

U.S. PATENT DOCUMENTS

| | | | | |
|---|---|---|---|---|
| 9,496,616 | B2 | 11/2016 | Toyao | |
| 9,748,641 | B2 * | 8/2017 | Miura | H01Q 1/38 |
| 2011/0109525 | A1 | 5/2011 | Takemura et al. | |
| 2012/0223869 | A1 | 9/2012 | Kim et al. | |

(Continued)

FOREIGN PATENT DOCUMENTS

| | | | |
|---|---|---|---|
| JP | S 63-238726 | A | 10/1988 |
| JP | H 08-078947 | A | 3/1996 |

(Continued)

*Primary Examiner* — Howard Williams

(74) *Attorney, Agent, or Firm* — Knobbe, Martens, Olson & Bear, LLP

(57) ABSTRACT

According to one embodiment, an antenna device includes first and second split ring resonators and a power supply line. The first split ring resonator includes a conductor enclosing a first opening and having a first void separating a part of the conductor. The second split ring resonator is opposed to the first split ring resonator, including a conductor which encloses a second opening and has a second void separating a part of the conductor. The power supply line feeds power to the first or second split ring resonator. The first split ring resonator is not electrically connected to the second split ring resonator. The first void does not overlap with the second void in an opposing direction of the first split ring resonator and the second split ring resonator.

16 Claims, 28 Drawing Sheets

(56) References Cited

U.S. PATENT DOCUMENTS

| | | | | |
|---|---|---|---|---|
| 2014/0203993 | A1* | 7/2014 | Toyao ..... | H01Q 13/10<br>343/867 |
| 2015/0288071 | A1 | 10/2015 | Toyao | |
| 2015/0303576 | A1 | 10/2015 | Latrach et al. | |
| 2015/0380809 | A1 | 12/2015 | Uchida | |
| 2016/0072167 | A1 | 3/2016 | Kawai et al. | |
| 2016/0072194 | A1 | 3/2016 | Yoshida et al. | |

FOREIGN PATENT DOCUMENTS

| | | | |
|---|---|---|---|
| JP | 2003-142937 | A | 5/2003 |
| JP | 5666729 | B1 | 2/2015 |
| JP | 2015-065643 | A | 4/2015 |
| JP | 5863730 | B2 | 2/2016 |
| JP | 6077507 | B2 | 2/2017 |
| JP | 6138839 | B2 | 5/2017 |
| KR | 2012-0004250 | A | 1/2012 |
| WO | WO 2013/027824 | A1 | 2/2013 |
| WO | WO 2014/073703 | A1 | 5/2014 |
| WO | WO 2014/192268 | A1 | 12/2014 |

* cited by examiner

ANTENNA DEVICE

CROSS REFERENCE TO RELATED APPLICATIONS

This application is based upon and claims the benefit of priority from the prior Japanese Patent Application No. 2016-215304, filed on Nov. 2, 2016, the entire contents of which are incorporated herein by reference.

FIELD

Embodiments described herein relate to an antenna device.

BACKGROUND

An antenna device in which a plurality of split ring resonators (SRRs) are electrically connected using a conductive via-hole is known. In this antenna device, as a method for lowering a resonant frequency without increasing an area, there is a case where a width of a void provided at the SRR is decreased. However, there are limitations to decrease of the width of the void for manufacturing reasons. Therefore, it is impossible to lower the resonant frequency to equal to or less than a certain frequency, and there are limitations to size reduction of the antenna device.

DETAILED DESCRIPTION

According to one embodiment, an antenna device includes a first split ring resonator, a second split ring resonator and a power supply line. The first split ring resonator includes a conductor enclosing a first opening and having a first void separating a part of the conductor. The second split ring resonator is opposed to the first split ring resonator, and includes a conductor enclosing a second opening and having a second void separating a part of the conductor. The power supply line feeds power to the first split ring resonator or the second split ring resonator. The first split ring resonator is not electrically connected to the second split ring resonator. The first void does not overlap with the second void in an opposing direction of the first split ring resonator and the second split ring resonator.

Embodiments of the present invention will be described below with reference to the drawings.

First Embodiment

Figure 1:
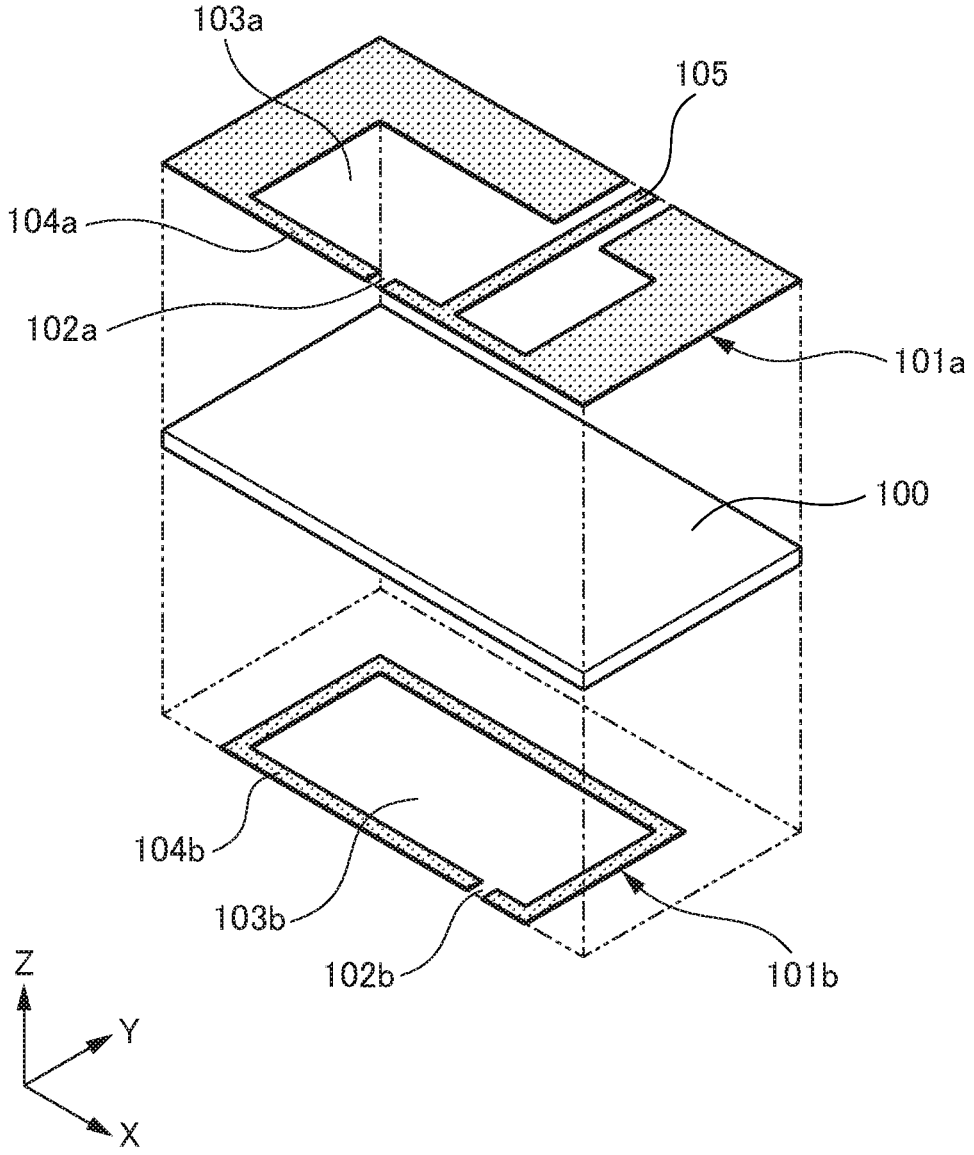
FIG. 1 is a diagram illustrating a schematic configuration of an antenna device according to a first embodiment.
Figure 2:
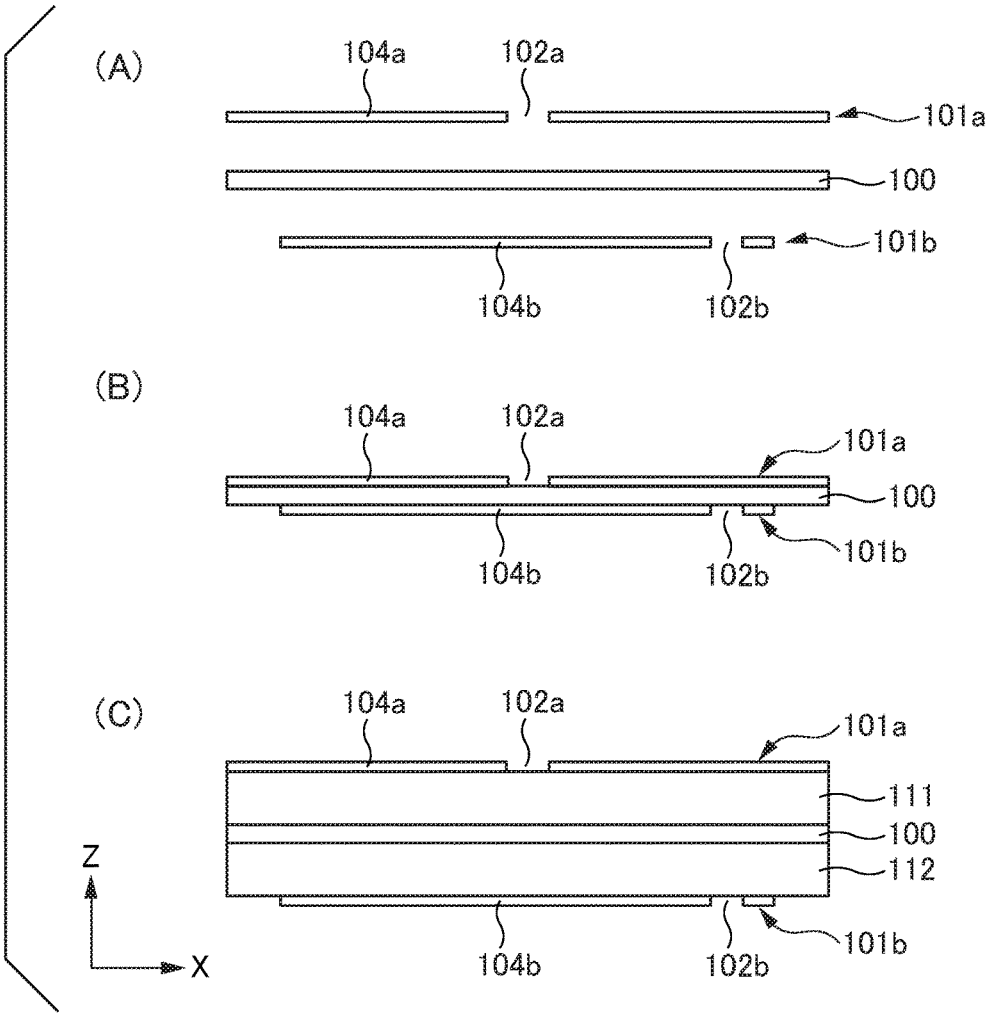
FIG. 2 is a side view of the antenna device according to the first embodiment.

FIG. 1 is a diagram illustrating an example of a schematic configuration of an antenna device according to a first embodiment of the present invention. FIG. 2A is a side view of the antenna device in FIG. 1 viewed from a negative direction on a Y axis.

The antenna device includes two conductor layers 101*a* and 101*b*, and an insulation layer (dielectric layer) 100 disposed between the two conductor layers 101*a* and 101*b*.

The insulation layer 100 may be a dielectric layer formed with, for example, Teflon, epoxy, alumina, ceramic, or may be a layer formed plastic. As the insulation layer 100, a rigid substrate or a foldable flexible substrate may be used.

The first conductor layer 101*a* and the second conductor layer 101*b* are formed with, for example, a metal or a conductive material such as copper, aluminum, gold and silver or combination thereof. The first conductor layer 101*a* and the second conductor layer 101*b* may be sheets, or conductive patterns obtained by patterning a conductor film, fine wires arranged in a grid shape, lead wires, or combination thereof.

The first conductor layer 101*a* is disposed at a fixed distance from an upper face of the insulation layer 100 toward a positive direction on a Z axis. The second conductor layer 101*b* is disposed at a fixed distance from a lower face of the insulation layer 100 toward a negative direction on the Z axis. The first conductor layer 101*a* is opposed to the second conductor layer 101*b* via the insulation layer 100 in between, and the first conductor layer 101*a* and the second conductor layer 101*b* are substantially parallel. The first conductor layer 101*a* and the second conductor layer 101*b* do not have to be planes and may be curves like a conductor on a folded flexible substrate.

While a layer of air exists between the first conductor layer 101*a* and the insulation layer 100, there may be an insulation layer other than air. While a layer of air exists between the second conductor layer 101*b* and the insulation layer 100, there may be an insulation layer other than air. The first conductor layer 101*a* and the second conductor layer 101*b* are supported at positions illustrated in the drawings by a mechanism which is not illustrated. Further, it is also possible to remove the insulation layer 100 from FIG. 1 and FIG. 2A, and only a layer of air may be provided between the first conductor layer 101*a* and the second conductor layer 101*b*.

FIG. 2B is a side view illustrating another configuration example of the antenna device. An example where the first conductor layer 101*a* and the second conductor layer 101*b* are directly formed on a surface of the insulation layer 100 is illustrated. Further, FIG. 2C illustrates an example where an insulation layer 111 is disposed between the first conductor layer 101*a* and the insulation layer 100, and an insulation layer 112 is disposed between the second conductor layer 101*b* and the insulation layer 100. In this case, a printed circuit board may be configured with the first conductor layer 101*a* and the insulation layer 111, and a printed circuit board may be configured with the second conductor layer 101*b* and the insulation layer 112. In the following description, description will be provided assuming the configuration in FIG. 2A.

As illustrated in FIG. 1, the first conductor layer 101*a* includes a split ring resonator (SRR) 104*a*. The SRR 104*a* is a conductor which encloses an opening 103*a* and in which a void 102*a* separating a part of the conductor in a direction enclosing the opening 103*a*. The void may be called a gap or a space.

The second conductor layer 101*b* includes a split ring resonator (SRR) 104*b*. The SRR 104*b* is a conductor which encloses an opening 103*b* and in which a void 102*b* separating a part of the conductor in a direction enclosing the opening 103*b*.

While, in the example in the drawings, it is assumed that the SRRs 104*a* and 104*b* are formed with a sheet-like material or a conductor pattern, as mentioned above, it is also possible to form the SRRs 104*a* and 104*b* with wires, lead wires, or the like.

Further, the SRRs 104*a* and 104*b* are electrically insulated from each other (not electrically connected).

The void 102*a* does not overlap with the void 102*b* when viewed from a direction in which the SRRs 104*a* and 104*b* are opposed to each other (i.e., in an opposing direction of the SRRs 104*a* and 104*b*). The direction in which the SRRs 104*a* and 104*b* are opposed to each other corresponds to the Z axis direction (a positive direction or a negative direction), that is, a direction perpendicular to a surface of the first conductor layer 101*a* or the second conductor layer 101*b*. For example, a region where the void 102*a* is projected in the negative direction on the Z axis does not overlap with the void 102*b*.

The shapes of the openings 103*a* and 103*b* may be quadrangles as illustrated in FIG. 1, or may be ellipses, polygons or complicated shapes obtained by combining curve lines and straight lines. The shape of the opening 103*a* may be different from the shape of the opening 103*b*.

The SRRs 104*a* and 104*b* may be formed at arbitrary locations of the first conductor layer 101*a* or the second conductor layer 101*b*. For example, the SRRs 104*a* and 104*b* may be formed at an end of the first conductor layer 101*a* or the second conductor layer 101*b* or may be formed near the center.

The first conductor layer 101*a* further includes a power supply line 105. The power supply line 105 is electrically connected to the SRR 104*a* and supplies (feeds) power to the SRR 104. A coplanar line is formed with the power supply line 105 and part of a conductor forming the SRR 104*a* (a conductor portion facing the power supply line 105 in an X axis direction). Power is fed to an antenna using the coplanar line. As the power supply line, lines of other power feeding schemes such as a microstrip line may be used. A high frequency signal is supplied to the power supply line 105 from a radio frequency (RF) circuit which generates a high frequency signal. When the high frequency signal is supplied, the SRR 104*a* and the SRR 104*b* resonate, and an electromagnetic wave is emitted to space. That is, the SRR 104*a* and the SRR 104*b* function as antennas. Note that, while the power supply line 105 separates a part of the conductor which encloses the opening 103*a* as illustrated in FIG. 1, the power supply line 105 may be provided at a position where the power supply line 105 does not separate a part of the conductor, such as in the case where the power supply line 105 is provided on other layers.

Figure 3:
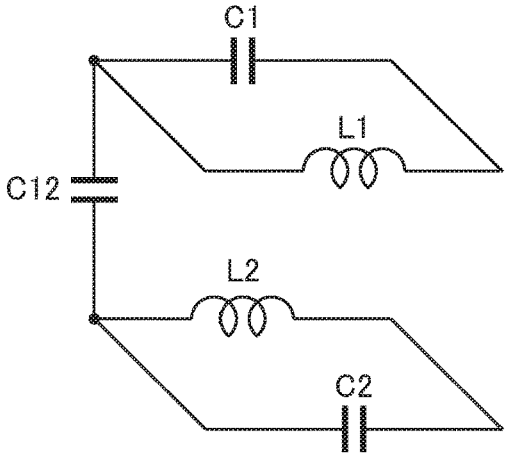
FIG. 3 is an equivalent circuit diagram of the antenna device according to the first embodiment.

FIG. 3 is an equivalent circuit diagram of the antenna device in FIG. 1. An equivalent circuit of the SRR 104*a* is expressed with an LC circuit in which an inductor L1 and a capacitor C1 are connected in series. An equivalent circuit of the SRR 104*b* is expressed with an LC circuit in which an inductor L2 and a capacitor C2 are connected in series. These LC circuits are connected to each other via a capacitor C12. The capacitor C12 is formed with a layer between the first conductor layer 101*a* and the second conductor layer 101*b* (in the example in FIG. 1, the insulation layer 100 and the layer of air). There is a case where inductance and capacitance of the inductor L1 and the capacitor C1 are respectively expressed as L1 and C1. There is a case where inductance and capacitance of the inductor L2 and the capacitor C2 are respectively expressed as L2 and C2. There is a case where capacitance of a capacitor C12 is expressed as C12.

According to the above-described configuration, it is possible to realize a small antenna device. Reasons for this will be described below.

A resonant frequency of the SRR 104*a* is inversely proportional to the square root of a product of the inductance L1 and the capacitance C1 of the SRR 104*a*. In a similar manner, a resonant frequency of the SRR 104*b* is inversely proportional to the square root of a product of the inductance L2 and the capacitance C2 of the SRR 104*b*. Therefore, it can be considered that the inductances L1 and L2 and the capacitances C1 and C2 are increased to lower the resonant frequency (to make the antenna smaller with a wavelength ratio). While it is possible to increase the inductances L1 and L2 by increasing areas of the openings 103*a* and 103*b* of the SRRs 104*a* and 104*b*, an area of the antenna is increased. As a method for lowering the resonant frequency without making the antenna larger, there is a method in which the capacitances C1 and C2 are increased. It can be considered that the voids 102*a* and 102*b* are narrowed down to increase the capacitances C1 and C2. However, there are limitations to narrowing down of the width of the voids 102*a* and 102*b* for manufacturing reasons. For example, in the case where an SRR is generated on a substrate, it is impossible to make the width of the void equal to or less than a minimum conductor interval of the substrate.

In the present embodiment, the capacitance C12 is generated by the SRRs 104*a* and 104*b* being not electrically connected to each other. The resonant frequency can be lowered by this capacitance C12. If the insulation layer 100 is made thin, the capacitance C12 between the SRRs 104*a* and 104*b* is increased, and it is possible to further lower the resonant frequency. Further, in the present embodiment, when viewed from the Z axis direction, the void 102*a* does not overlap with the void 102*b*. By this means, it is possible to further increase the capacitance C12 and further lower the resonant frequency. This will be described further in detail. It is observed through simulation that, if one SRR is rotated in parallel to an XY plane from a state where the void 102*a* matches the void 102*b* when viewed from the Z axis direction, the resonant frequency is gradually lowered, and when the voids 102*a* and 102*b* are located at positions opposite from each other (see FIG. 4A, which will be described later), the resonant frequency becomes the lowest. This means that when the void 102*a* matches the void 102*b*, the capacitance C12 becomes the smallest, and when the voids 102*a* and 102*b* are located at positions opposite from each other, the capacitance C12 becomes the largest. Therefore, in the present embodiment, by at least preventing the void 102*a* from overlapping with the void 102*b* when viewed from the Z axis direction, it is possible to increase the capacitance C12 and lower the resonant frequencies of the SRRs 104*a* and 104*b* without increasing the antenna size.

Modified examples of the first embodiment will be described below.

Figure 4A:
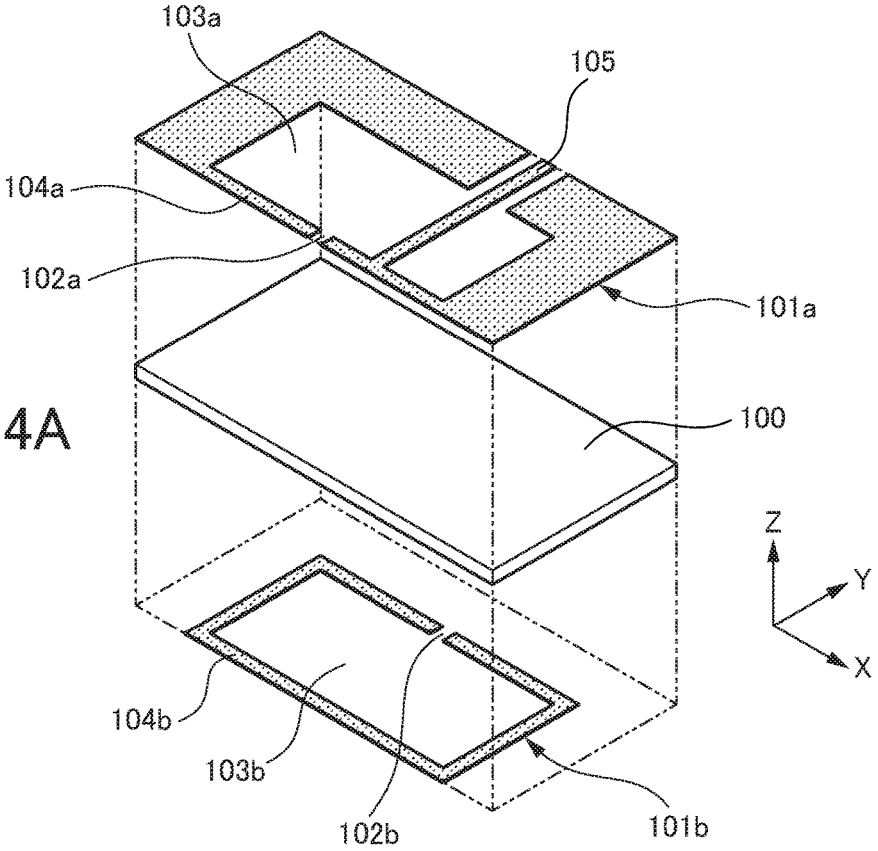
FIG. 4A is a diagram illustrating a first modified example of the antenna device according to the first embodiment.
Figure 4B:
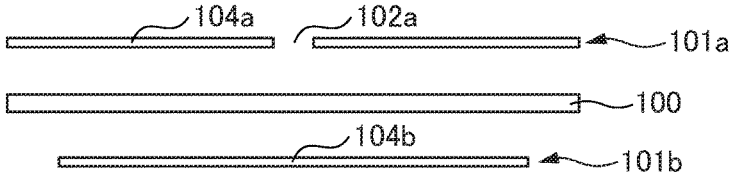
FIG. 4B is a side view of the antenna device in FIG. 4A.
Figure 4C:
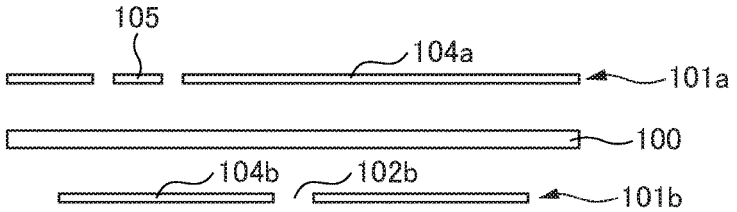
FIG. 4C is a side view of the antenna device in FIG. 4A.

FIG. 4A is a schematic configuration diagram of an antenna device according to a first modified example. FIG. 4B is a side view viewed from a negative direction on the Y axis, and FIG. 4C is a side view viewed from a positive direction on the Y axis. The void 102*b* is disposed at an opposite side from the void 102*a* when viewed from the Z axis direction. By disposing the void 102*b* in this manner, because the capacitance between the SRRs 104*a* and 104*b* is increased, it is possible to further lower the resonant frequencies.

Figure 5:
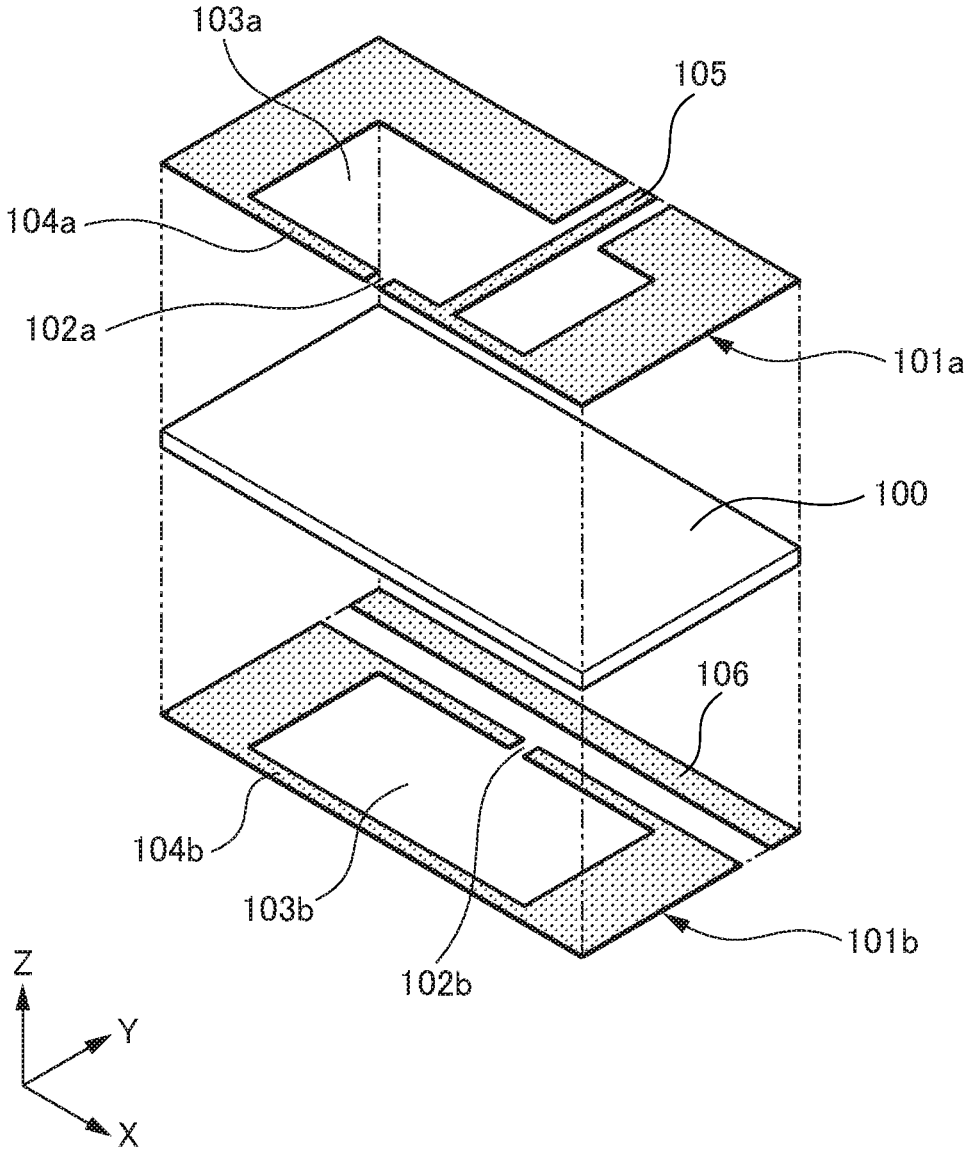
FIG. 5 is a diagram illustrating a second modified example of the antenna device according to the first embodiment.

FIG. 5 is a schematic configuration diagram of an antenna device according to a second modified example. This antenna device is an antenna device which feeds power with a coplanar line with a ground plate. The second conductor layer 101*b* includes a ground 106 of the coplanar line with a ground. The coplanar line with a ground is formed with the power supply line 105, part of the conductor forming the SRR 104*a* (a conductor portion facing the power supply line 105 in the X axis direction), the insulation layer 100, the layer of air (between the insulation layer 100 and the first and second conductor layers) and the ground 106. The ground 106 is electrically connected to the SRR 104*a* with a structure which is not illustrated, and is not electrically connected to the SRR 104*b*. If power is fed using the coplanar line with a ground plate, it is possible to suppress unnecessary emission of an electromagnetic wave from the power supply line 105, so that it is possible to prevent change in directivity of the antenna and degradation of efficiency. Note that, while, in the example in FIG. 5, an area of the conductor of the SRR 104*b* is made larger than that in FIG. 1, or the like, there is little change in characteristics of the antenna by this change, because a current flows along a contour of the opening 103*b*. It is also possible to make an area of the conductor of the SRR 104*b* larger in a similar manner to the present modified example also in other antenna devices mentioned above.

Figure 6:
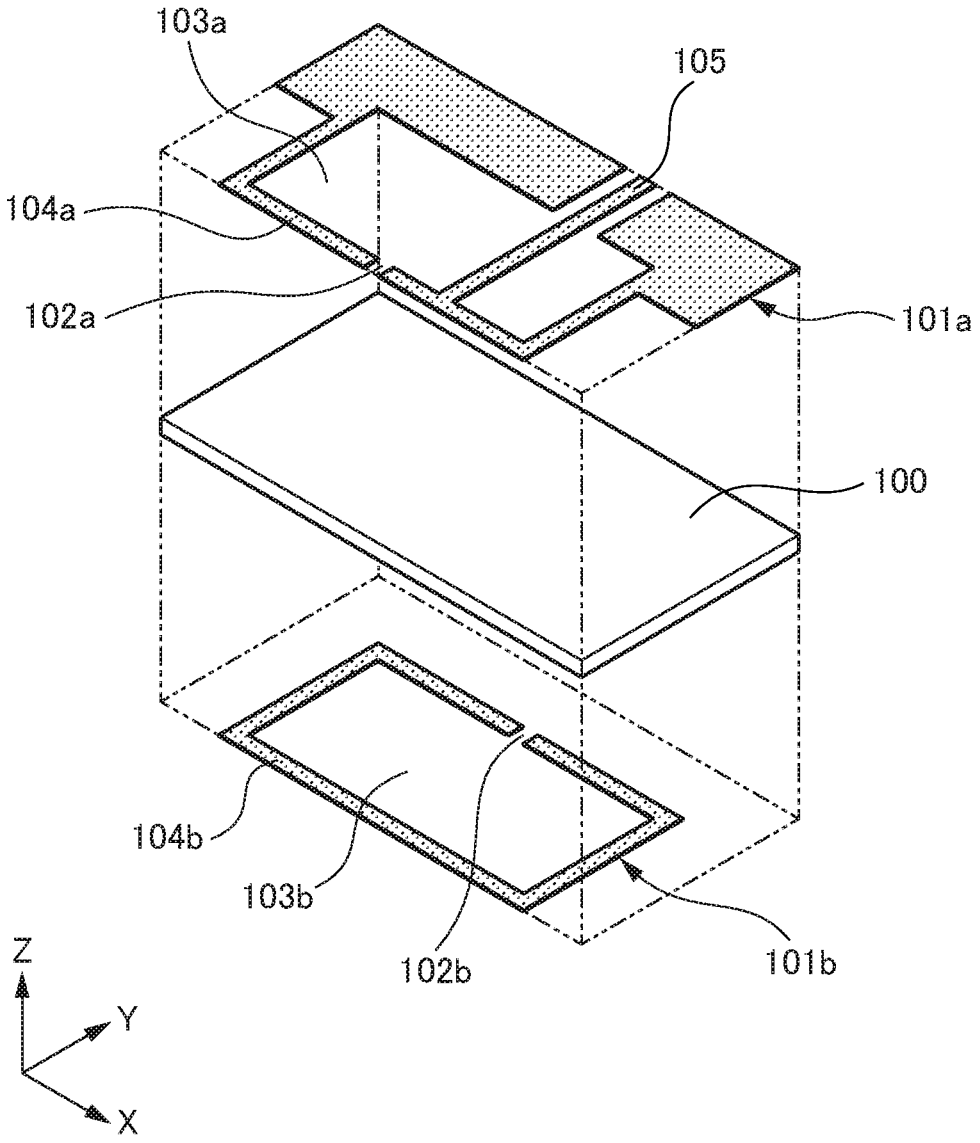
FIG. 6 is a diagram illustrating a third modified example of the antenna device according to the first embodiment.

FIG. 6 is a schematic configuration diagram of an antenna device according to a third modified example. An area of the conductor around the SRR 104*a* is made small. Because a current flows along a contour of the opening 103*a*, even if the area of the conductor around the SRR 104*a* is reduced, operation of the antenna is not affected. Because the size of the area of the conductor of the first conductor layer 101*a* can be made close to the size of the area of the conductor of the second conductor layer 101*b* by reducing the area of the conductor, in the case where the antenna device is formed on the printed circuit board, it is possible to suppress warpage of the substrate.

Figure 7:
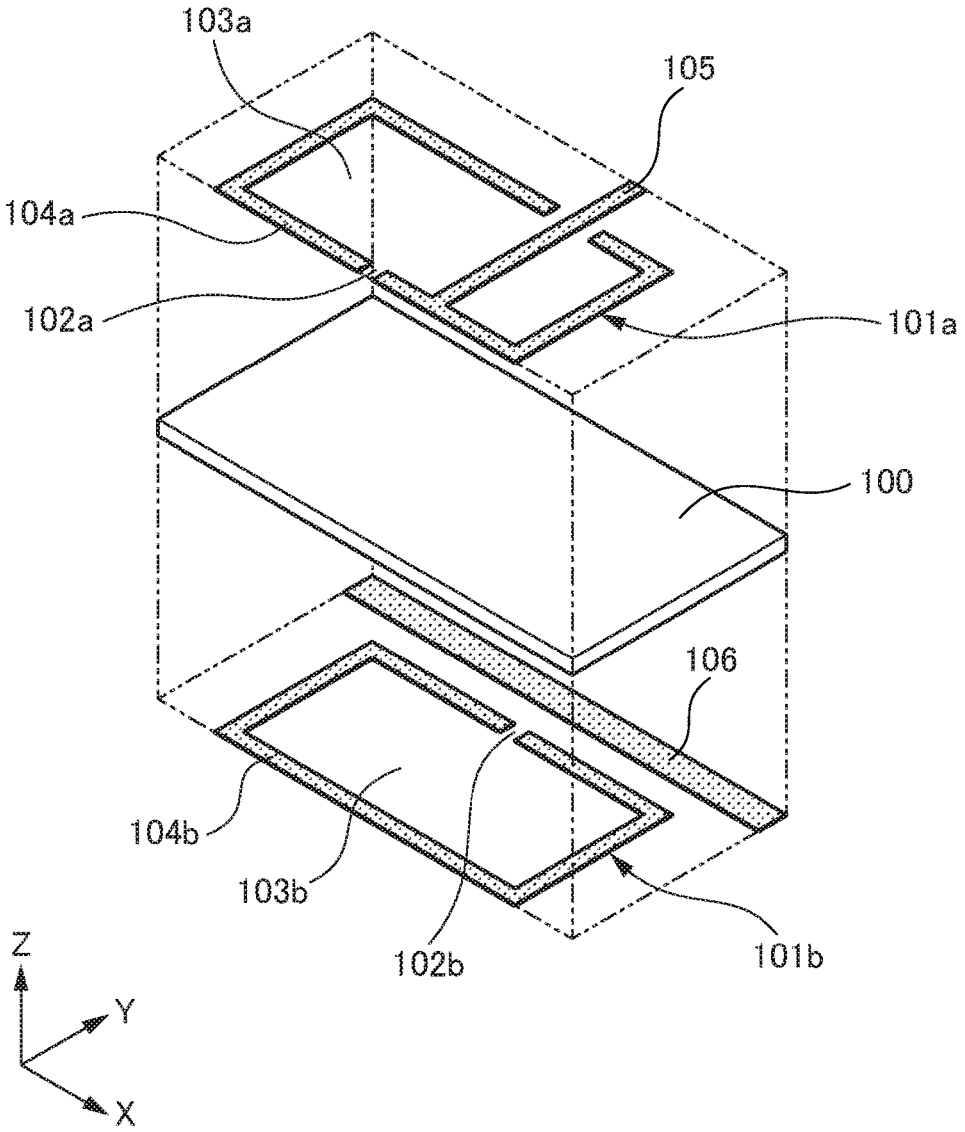
FIG. 7 is a diagram illustrating a fourth modified example of the antenna device according to the first embodiment.

FIG. 7 is a schematic configuration diagram of an antenna device according to a fourth modified example. In this antenna device, power is fed through a microstrip line. The second conductor layer 101*b* includes the ground 106 of the microstrip line. The microstrip line is formed with the power supply line 105, the insulation layer 100, the layer of air (between the insulation layer 100 and the first and the second conductor layers) and the ground 106. Because the area of the conductor of the first conductor layer 101*a* is reduced by power being fed through the microstrip line, it is possible to dispose, for example, a circuit component or wiring, in an empty region. Note that, as in the case with the configuration in FIG. 4, the void 102*b* is formed at an opposite side from the void 102*a* of the SRR 104*a*. The SRR 104*b* is not electrically connected to the ground 106.

Figure 8:
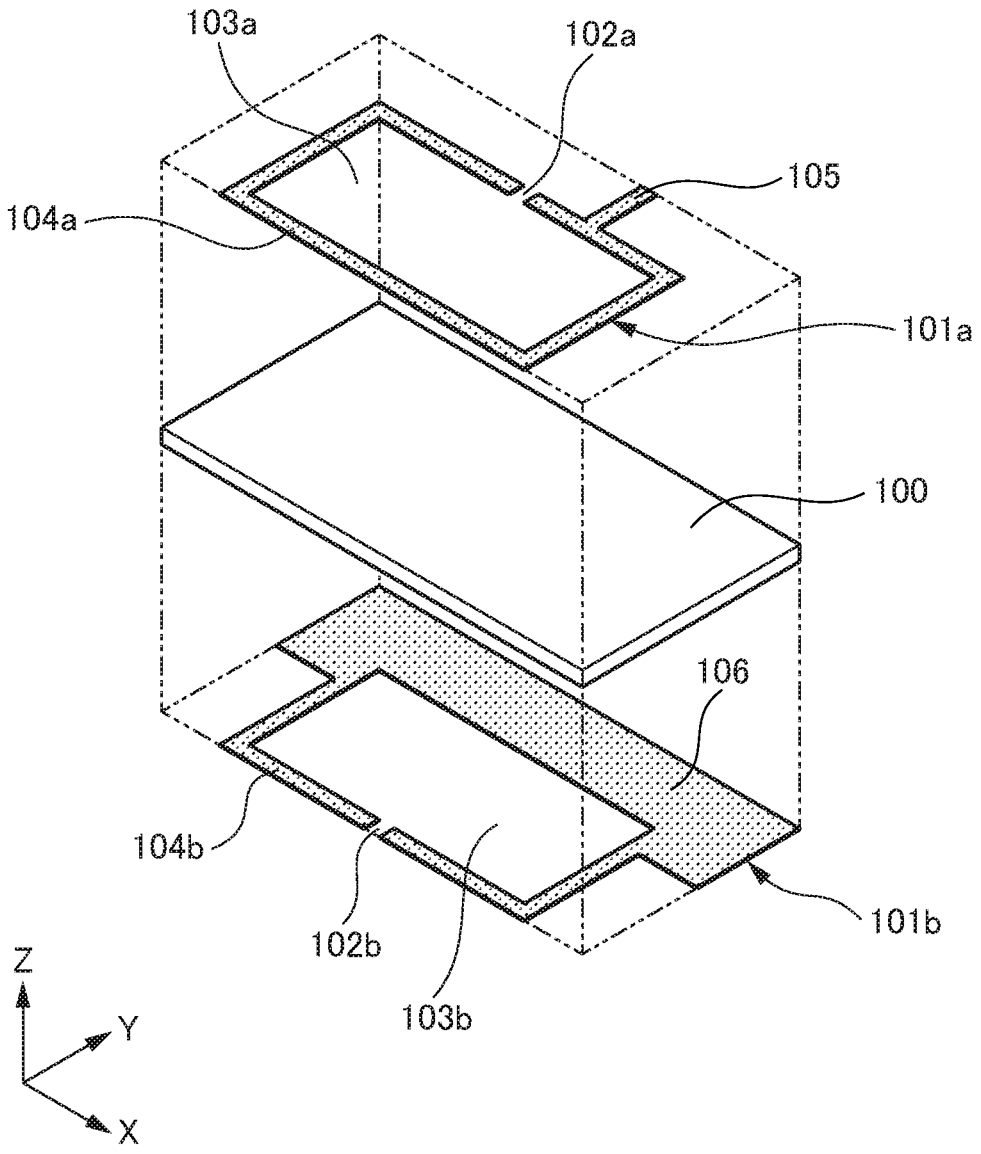
FIG. 8 is a diagram illustrating a fifth modified example of the antenna device according to the first embodiment.

FIG. 8 is a schematic configuration diagram of an antenna device according to a fifth modified example. As in the case with FIG. 7, power is fed through a microstrip line. The void 102*a* is formed along the Y axis direction at an opposite side from FIG. 1, or the like. The power supply line 105 is connected to the SRR 104*a* without separating the conductor enclosing the opening 103*a*. Further, the void 102*b* is formed at an opposite side from the void 102*a* when viewed from the Z axis direction. Part of the conductor forming the SRR 104*b* (portion at the opposite side from the void 102*b*) is electrically connected to the ground 106. If portions facing each other with the void 102*b* in between are not electrically connected, there is no problem even if part of the SRR 104*b* is connected to the ground 106 in this manner.

Figure 9A:
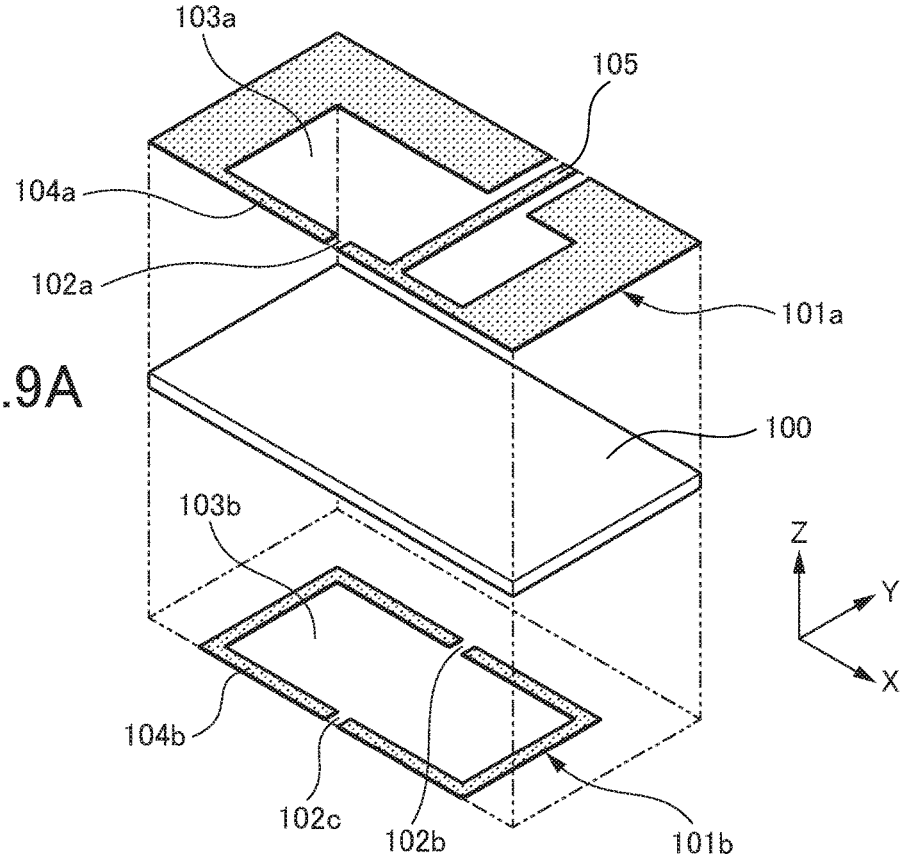
FIG. 9A is a diagram illustrating a sixth modified example of the antenna device according to the first embodiment.
Figure 9B:
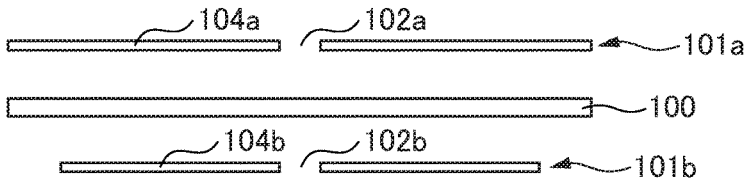
FIG. 9B is a side view of the antenna device in FIG. 9A.
Figure 9C:
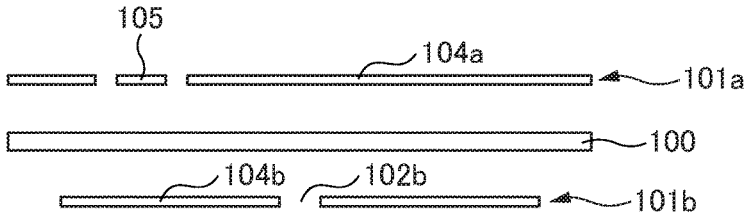
FIG. 9C is a side view of the antenna device in FIG. 9A.

FIG. 9A is a schematic configuration diagram of an antenna device according to a sixth modified example. FIG. 9B is a side view viewed from a negative direction on the Y axis. FIG. 9C is a side view viewed from a positive direction on the Y axis. In the SRR 104*b*, in addition to the void 102*b*, a void 102*c* is provided at a conductor portion enclosing the opening 103*b*. The void 102*b* and the void 102*c* are formed at opposite sides from each other along the Y axis direction. Because a plurality of capacitances are added in series by a plurality of voids being provided in this manner, synthesized capacitance becomes small, and a resonant frequency of the SRR 104*b* becomes high. Meanwhile, because there is little change in capacitance between the SRRs 104*a* and 104*b* (see C12 in FIG. 3), there is little change in a resonant frequency of the SRR 104*a*. It is therefore possible to obtain an effect of multi-resonance that the SRR 104*a* resonates at a low frequency and the SRR 104*b* resonates at a high frequency, while the size of the antenna is maintained.

In this example, while the void 102*a* overlaps with the void 102*c* when viewed from the Z axis direction, because the void 102*b* does not overlap with the void 102*a*, it is possible to obtain the above-mentioned effect of the present embodiment. That is, in the case where a plurality of voids are provided at the conductor of the SRR 104*b*, part of voids among these may overlap with the void 102*a*.

It is also possible to form a plurality of voids at the SRR 104*a* and form one void at the SRR 104*b*. Also in this case, it is possible to obtain effects similar to those of the antenna devices in FIG. 9A to FIG. 9C (small and multi-resonance).

In the above-described embodiment and each modified example, another insulation layer or another conductor layer or both of these may be provided over the first conductor layer (the positive direction on the Z axis) or under the second conductor layer (the negative direction on the Z axis). For example, a solder mask of the substrate or a sealing resin of a semiconductor package may be formed. Further, the antenna device of the first embodiment may be formed using only two layers of four-layered substrate.

Second Embodiment

Figure 10:
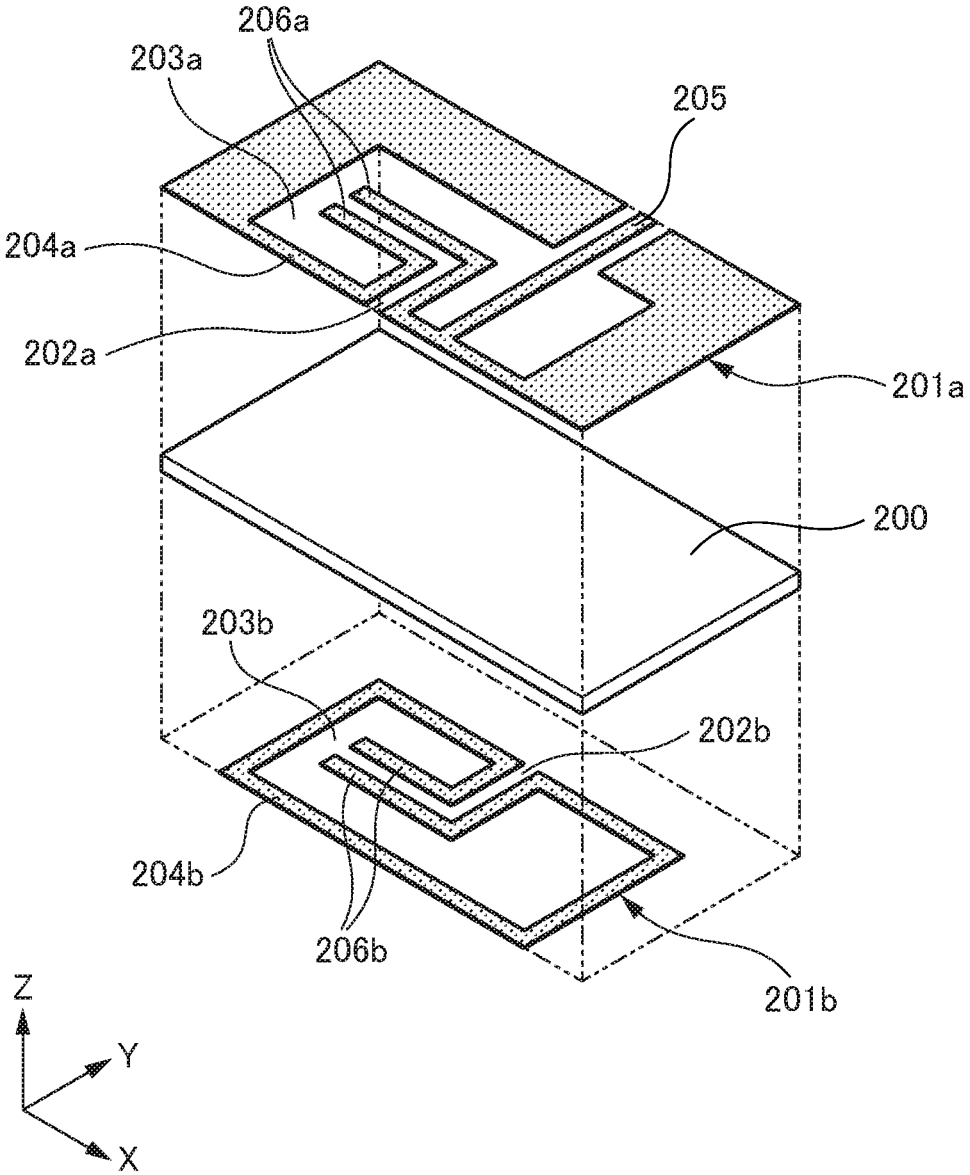
FIG. 10 is a diagram illustrating a schematic configuration of an antenna device according to a second embodiment.

FIG. 10 is a diagram illustrating an example of a schematic configuration of an antenna device according to a second embodiment of the present invention. The antenna device in FIG. 10 is based on the configurations in FIG. 4A to FIG. 4C of the first embodiment. A difference with FIG. 4A to FIG. 4C will be mainly described.

An SRR 204*a* includes belt-like conductors 206*a* which are respectively connected to conductor portions separated by a void 202*a* and which are parallel to each other. Further, an SRR 204*b* includes belt-like conductors 206*b* which are respectively connected to conductor portions separated by a void 202*b* and which are parallel to each other.

The belt-like conductors 206*a* and 206*b* are bend when viewed from the Z axis direction and have L shapes. However, the belt-like conductors 206*a* and 206*b* may be formed in linear shapes or may be formed with curved lines. The shapes of the belt-like conductors 206*a* and 206*b* may be different from each other.

Capacity is formed between the belt-like conductors 206*a*, which increases the capacitance of the SRR 204*a*. In a similar manner, capacity is formed between the belt-like conductors 206*b*, which increases the capacitance of the SRR 204*b*. It is therefore possible to further lower resonant frequencies of antennas (the SRRs 204*a* and 204*b*). By making the belt-like conductors 206*a* and 206*b* longer, the capacitance of these further increases, so that it is possible to further lower the resonant frequencies of the SRRs 204*a* and 204*b*.

Modified examples of the second embodiment will be described below.

Figure 11:
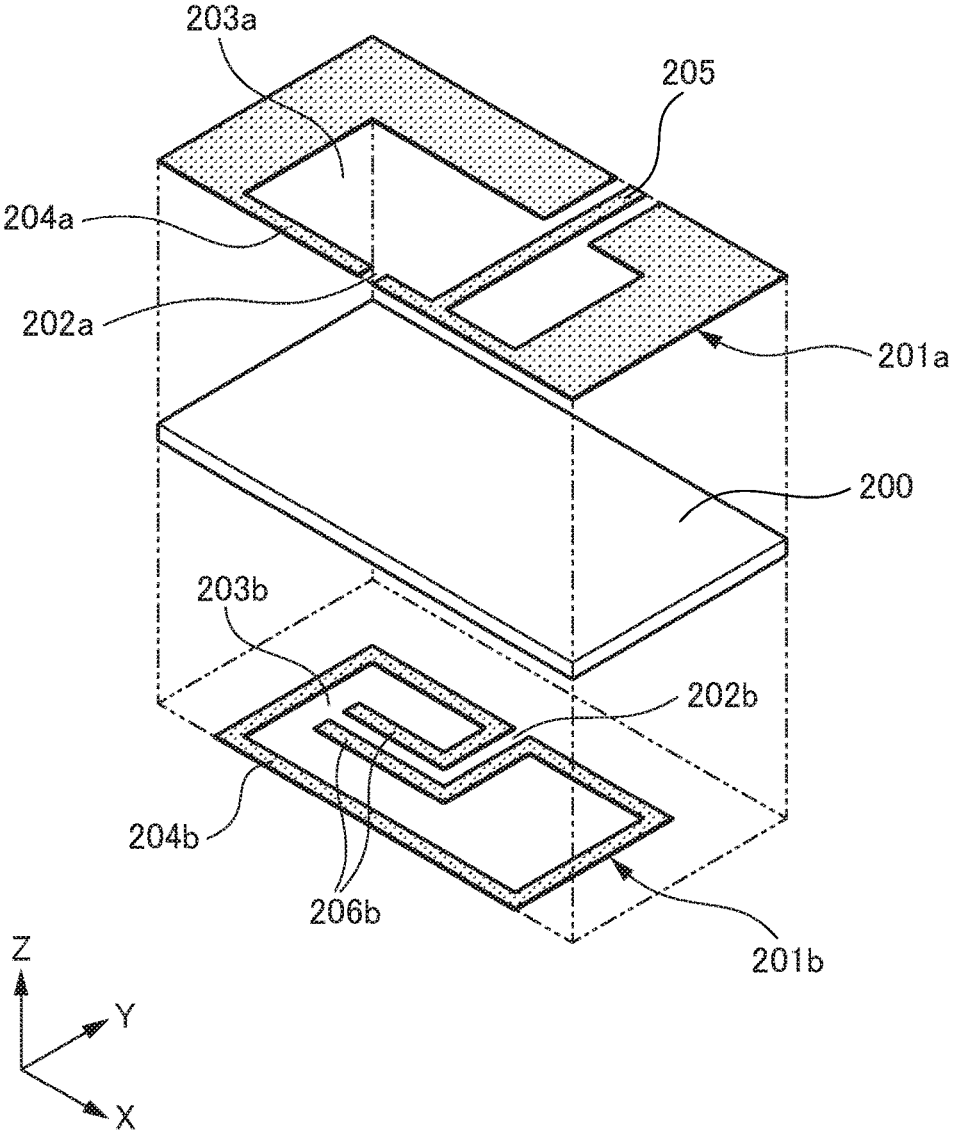
FIG. 11 is a diagram illustrating a first modified example of the antenna device according to the second embodiment.

FIG. 11 is a schematic configuration diagram of an antenna device according to a first modified example. While the SRR 204*b* includes belt-like conductors 206*b*, the SRR 204*a* does not include a belt-like conductor. According to such a configuration, only the capacitance of the SRR 204*b* increases, so that it is possible to lower the resonant frequency of the SRR 204*b*. It is therefore possible to obtain an effect of a lower frequency of the resonant frequency of one of the SRRs and an effect of multi-resonance while maintaining an area of the antenna. Also in the case where the SRR 204*a* includes belt-like conductors and the SRR 204*b* does not include a belt-like conductor, similar effects can be obtained.

Figure 12:
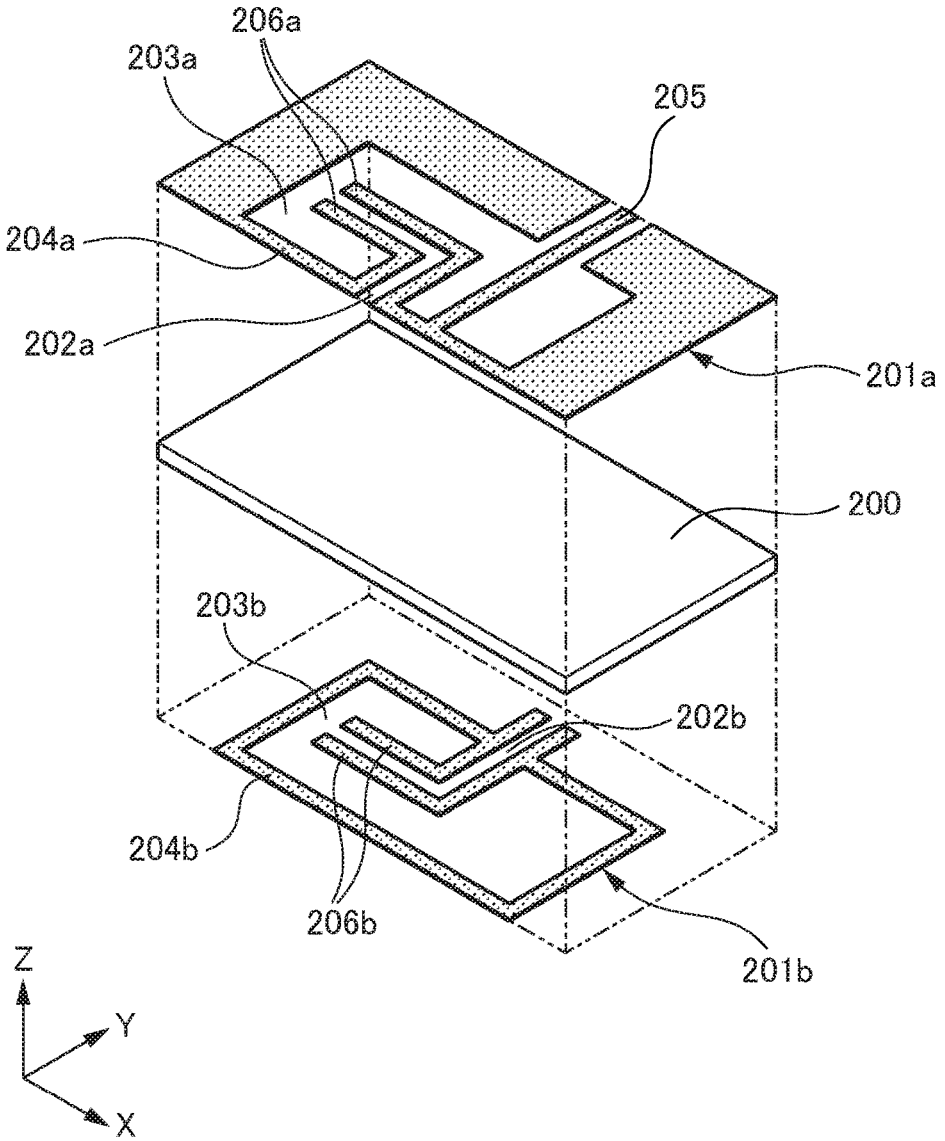
FIG. 12 is a diagram illustrating a second modified example of the antenna device according to the second embodiment.

FIG. 12 is a schematic configuration diagram of an antenna device according to a second modified example. The belt-like conductors 206*b* extend to outside of the opening 203*b*. As a result of the belt-like conductors 206*b* extending to outside of the opening 203*b*, while the antenna becomes slightly larger, because capacitance increases by an amount corresponding to the extension, it is possible to lower the resonant frequency. In a similar manner, the belt-like conductors 206*a* may extend to outside of the opening 203*a*.

Other than the above-described modified examples, the antenna device may be modified as illustrated in FIG. 4A to FIG. 9C.

Third Embodiment

Figure 13A:
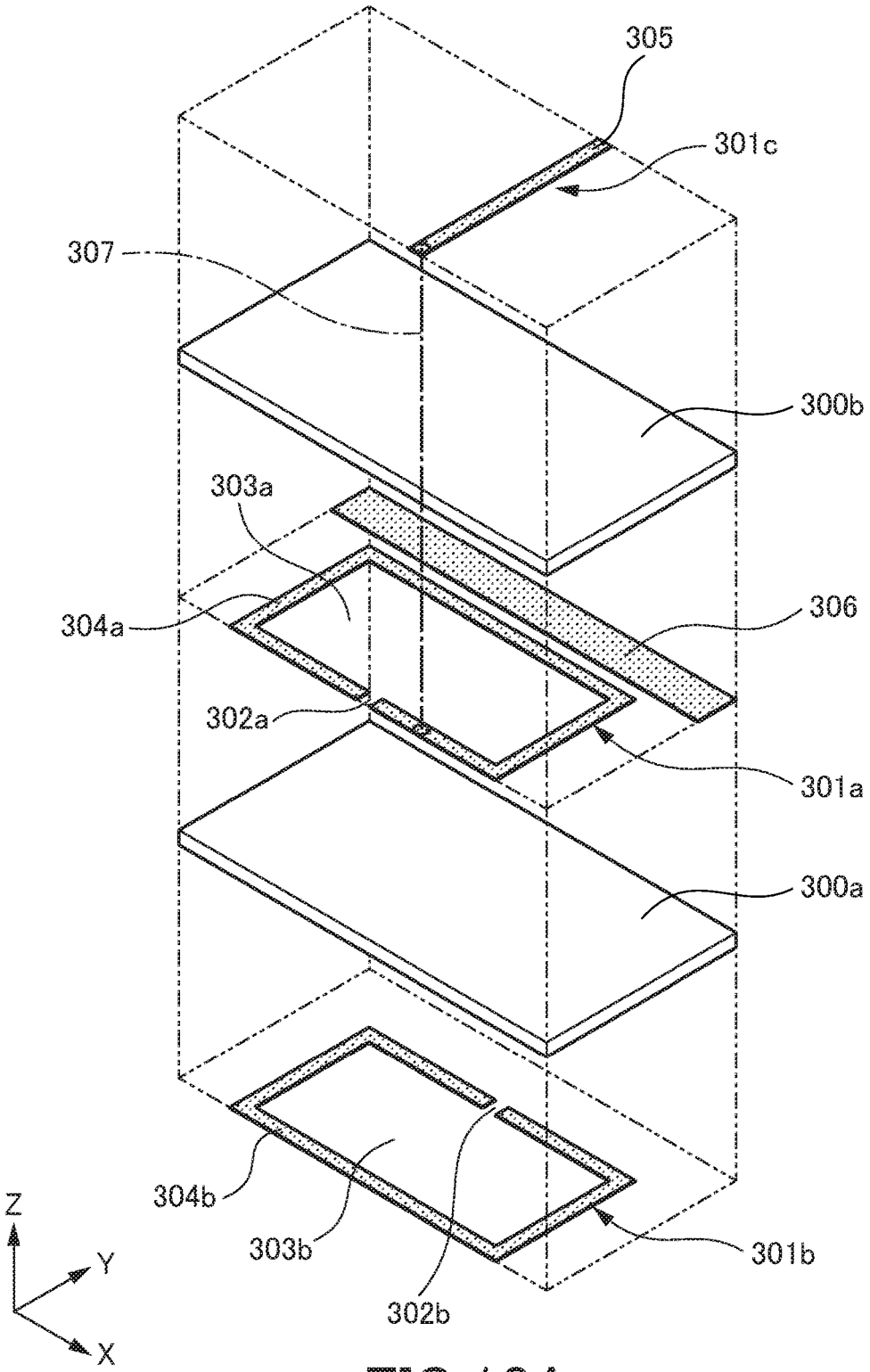
FIG. 13A is a diagram illustrating a schematic configuration of an antenna device according to a third embodiment.
Figure 13B:
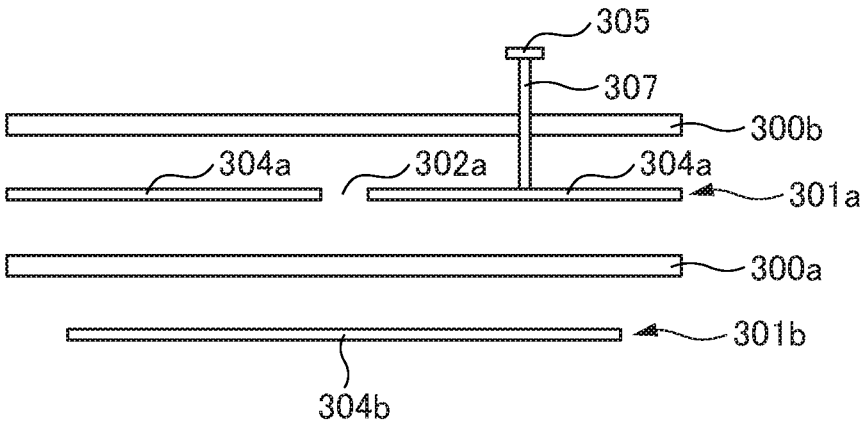
FIG. 13B is a side view of the antenna device in FIG. 13A.
Figure 13C:
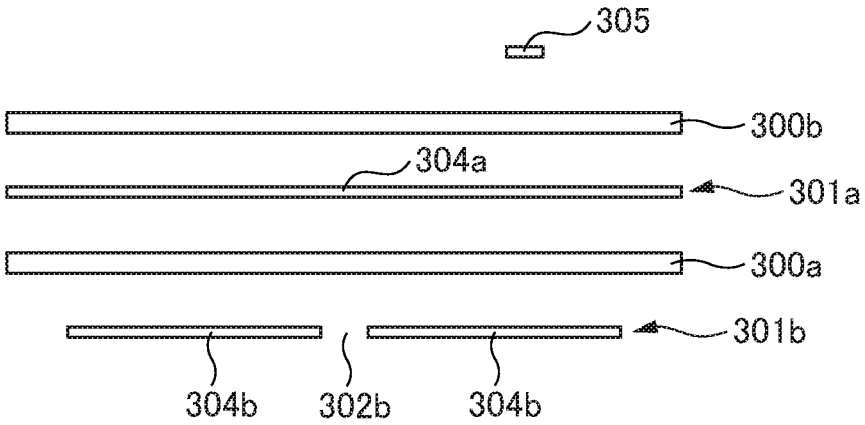
FIG. 13C is a side view of the antenna device in FIG. 13A.

FIG. 13A is a diagram illustrating an example of a schematic configuration of an antenna device according to a third embodiment of the present invention. FIG. 13B is a side view viewed from the negative direction on the Y axis, and FIG. 13C is a side view viewed from the positive direction on the Y axis.

The third embodiment is based on the first embodiment or the second embodiment. The antenna device includes a third conductor layer 301*c* over a first conductor layer 301*a* (the positive direction on the Z axis) with an insulation layer 300*b* in between. The insulation layer 300*b* is disposed between the third conductor layer 301*c* and the first conductor layer 301*a*. The insulation layer 300*b* can employ various configurations as in the case with an insulation layer 300*a*. The third conductor layer 301*c* includes a power supply line 305. That is, the power supply line 305 is provided at a position different from the positions of the first and second conductor layers along a direction in which the first and second conductor layers are opposed to each other, i.e., along an opposing direction of the first and second conductor layers (Z axis direction). The power supply line 305 is electrically connected to an SRR 304*a* of the first conductor layer 301*a* through a columnar conductor 307.

The columnar conductor 307 may be a via-hole formed by plating an inner side of a hole formed with a drill or laser, or a pin header, a conductive wire, a metal screw, or the like. These may be soldered to ensure electrical connection between the first conductor layer 301*a* and the power supply line 305.

The first conductor layer 301*a* includes a ground 306. A microstrip line is formed with the power supply line 305, the ground 306 and the insulation layer 300*b*. The ground 306 is electrically separated from the SRR 304*a*. However, as long as portions facing each other with a void 302*a* in between are not electrically connected, even if the ground 306 is connected to the SRR 304*a*, there is no problem in operation.

By the power supply line 305 being disposed on the third conductor layer 301*c*, a position where the power supply line 305 is connected to the SRR 304*a* can be freely selected, which makes it easier to achieve impedance matching (for example, the power supply line can be connected to a short side of a rectangle conductor enclosing an opening 303*a*). Further, because the power supply line 305 does not pass through inside of the opening 303*a*, the antenna operates more stably. Still further, in the case where a belt-like conductor (see FIG. 10 or FIG. 12) is formed, because a long belt-like conductor can be formed inside the opening 303*a*, it is possible to further lower the resonant frequency of the antenna.

While, in the examples in FIG. 13A to FIG. 13C, the third conductor layer 301*c* is disposed over the first conductor layer 301*a*, as another configuration example, the third conductor layer may be disposed below (the negative direction on the Z axis) of the second conductor layer 301*b*, and the power supply line may be formed on the third conductor layer. Further, an insulation layer may be disposed between the third conductor layer and the second conductor layer 301*b*. The power supply line and the second conductor layer 301*b* may be connected using a columnar conductor, or the like. The connection method may be similar to that in the above-described examples.

Modified examples of the third embodiment will be described below.

Figure 14:
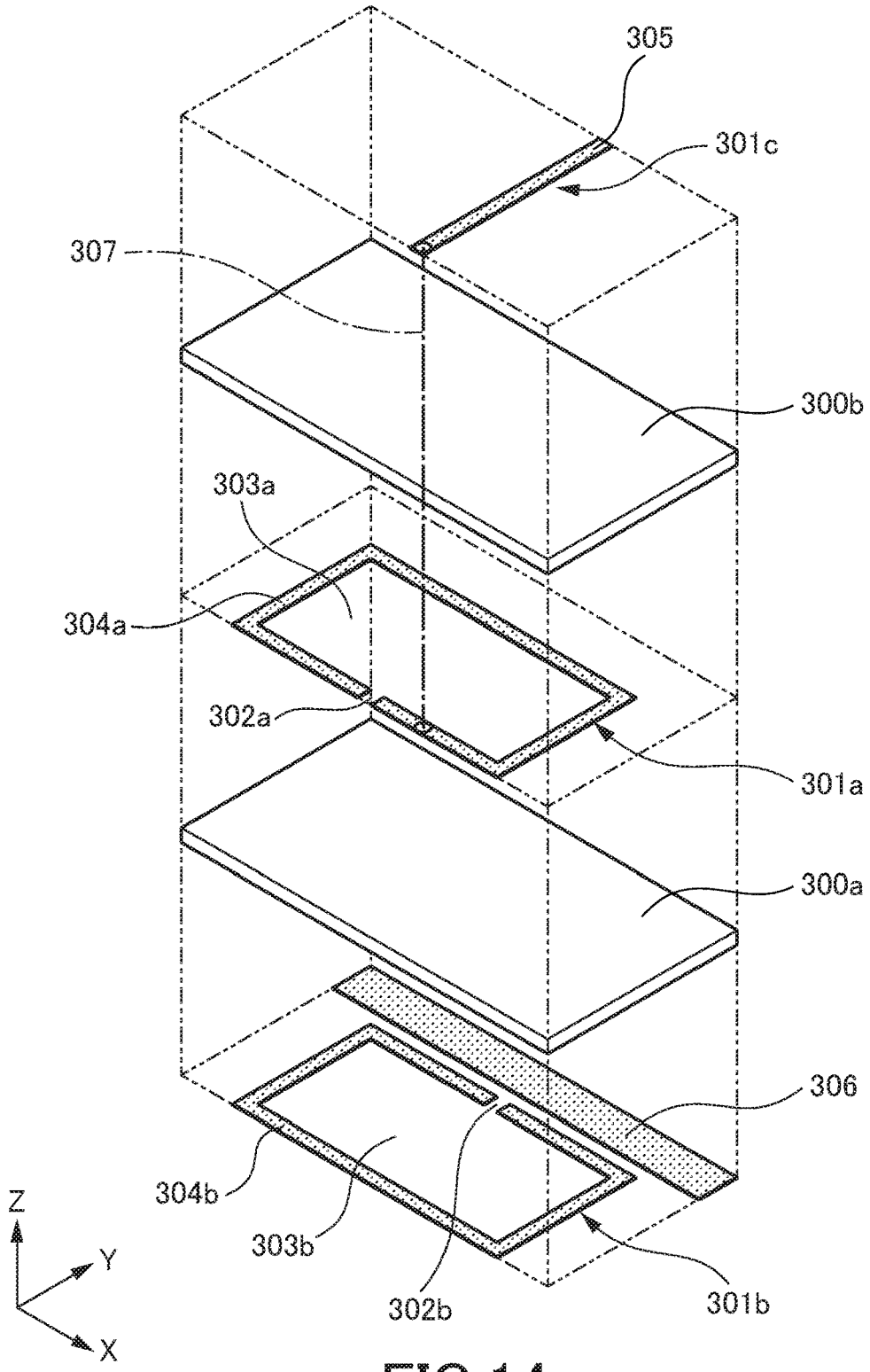
FIG. 14 is a diagram illustrating a first modified example of the antenna device according to the third embodiment.

FIG. 14 is a schematic configuration diagram of an antenna device according to a first modified example. In this antenna device, the ground 306 of the microstrip line is provided not on the first conductor layer 301*a* but on the second conductor layer 301*b*. By this means, characteristic impedance of the microstrip line becomes high, which makes it easier to achieve impedance matching in the case where input impedance of the antenna is high.

Figure 15:
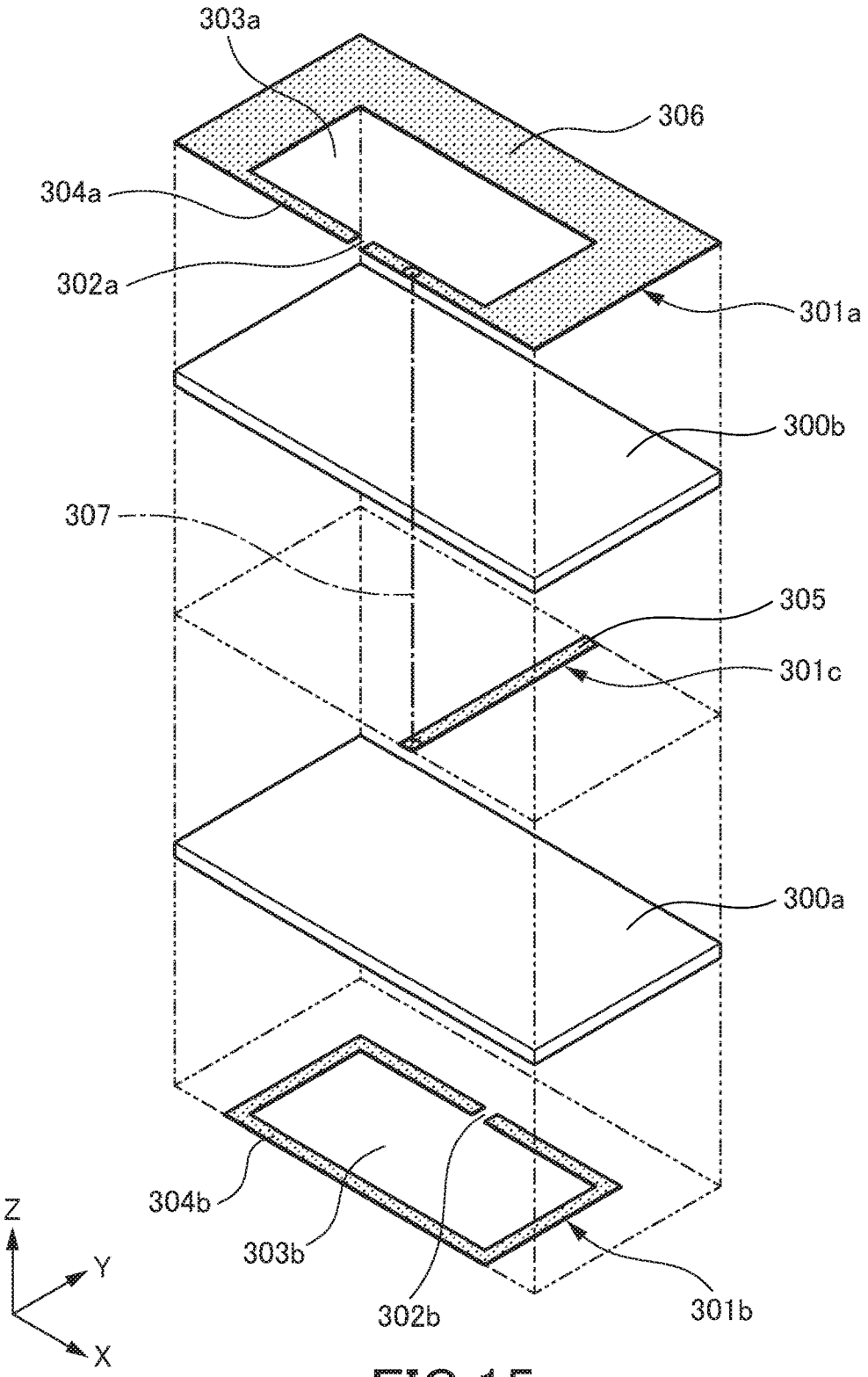
FIG. 15 is a diagram illustrating a second modified example of the antenna device according to the third embodiment.

FIG. 15 is a schematic configuration diagram of an antenna device according to a second modified example. The third conductor layer 301*c* is disposed between the first conductor layer 301*a* and the second conductor layer 301*b*. The insulation layer 300*b* is disposed between the third conductor layer 301*c* and the first conductor layer 301*a*. The first conductor layer 301*a* includes the ground 306 of the microstrip line, and the ground 306 is connected to the power supply line 305 through the columnar conductor 307. Because the ground 306 covers the power supply line 305 when viewed from the Z axis direction, it is possible to suppress unnecessary emission of an electromagnetic wave from the power supply line 305 to the first conductor layer 301*a* side. Note that it is also possible to form a ground on the second conductor layer 301*b*. In this case, it is possible to suppress unnecessary emission to the second conductor layer 301*b* side.

Figure 16:
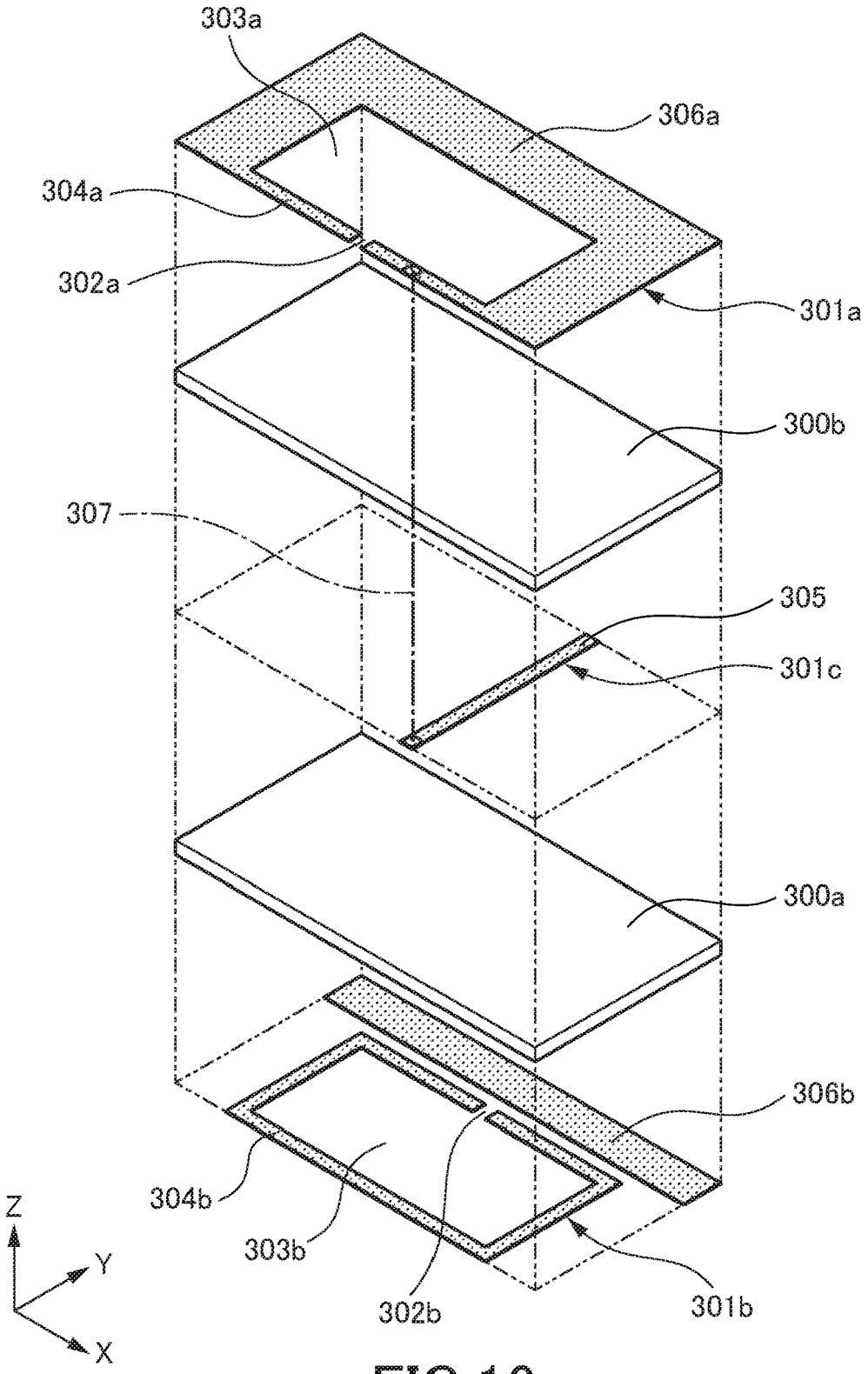
FIG. 16 is a diagram illustrating a third modified example of the antenna device according to the third embodiment.

FIG. 16 is a schematic configuration diagram of an antenna device according to a third modified example. Grounds 306*a* and 306*b* are respectively provided on the first conductor layer 301*a* and the second conductor layer 301*b*. A strip line is configured with the power supply line 305, the insulation layers 300*b* and 300*a*, the grounds 306*b* and 306*a* and a layer of air existing among these. The ground 306*b* is electrically connected to the first conductor layer 301*a* with a via-hole, or the like, which is not illustrated. The ground 306*b* and an SRR 304*b* are not electrically connected. Because the power supply line 305 is covered with the grounds 306*a* and 306*b*, it is possible to suppress unnecessary emission of an electromagnetic wave from the power supply line 305 in a direction to the first conductor layer 301*a* and the second conductor layer 301*b*.

Figure 17:
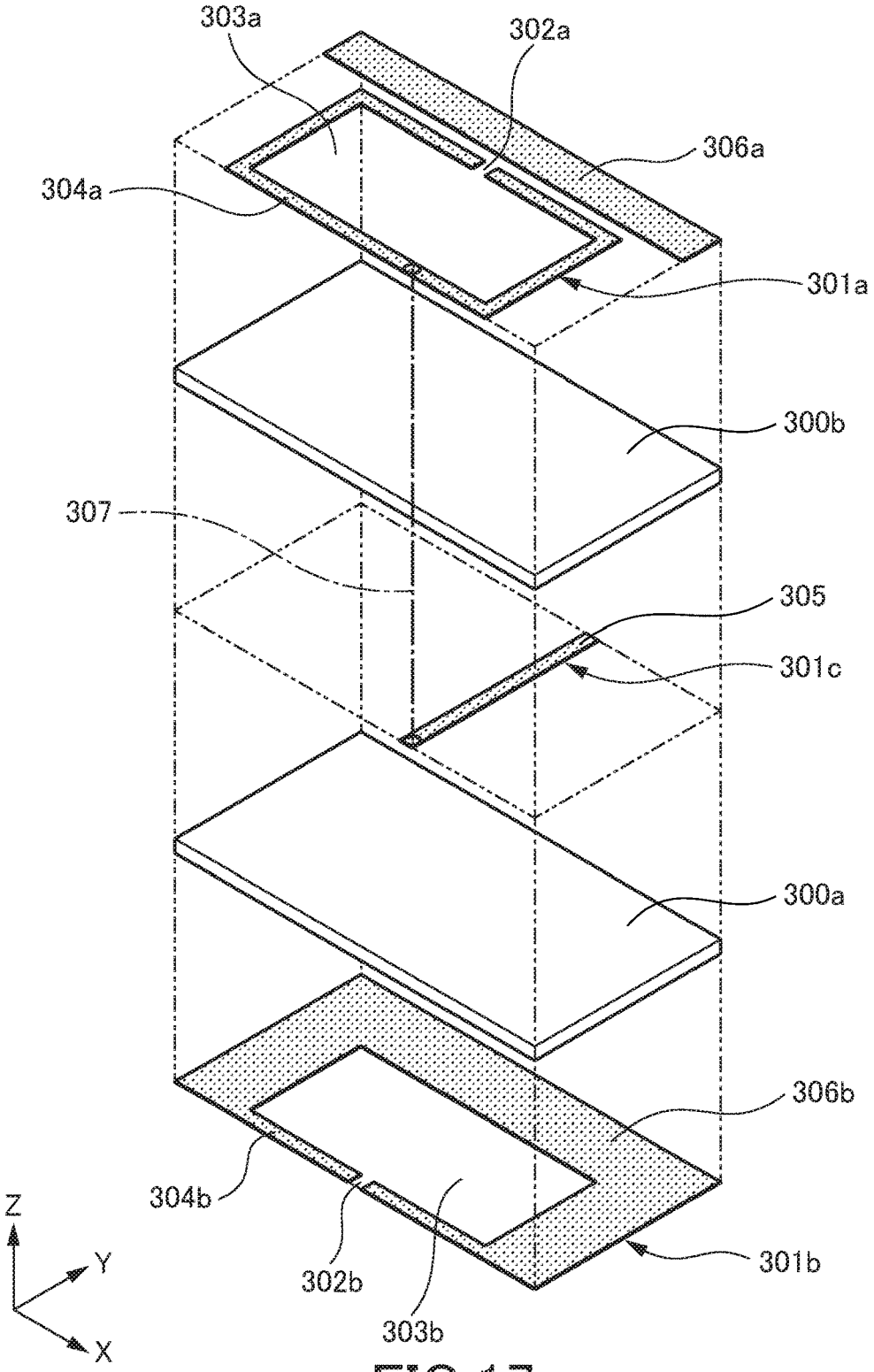
FIG. 17 is a diagram illustrating a fourth modified example of the antenna device according to the third embodiment.

FIG. 17 is a schematic configuration diagram of an antenna device according to a fourth modified example. The ground 306*b* is electrically connected to the SRR 304*b* (portions which are opposed to each other via a void 302*b* in between are not short-circuited). The ground 306*a* is not electrically connected to the SRR 304*a*. The ground 306*b* is electrically connected to the ground 306*a* with a via-hole, which is not illustrated. Also by this means, it is possible to obtain effects similar to those obtained from the configuration in FIG. 16.

Figure 18:
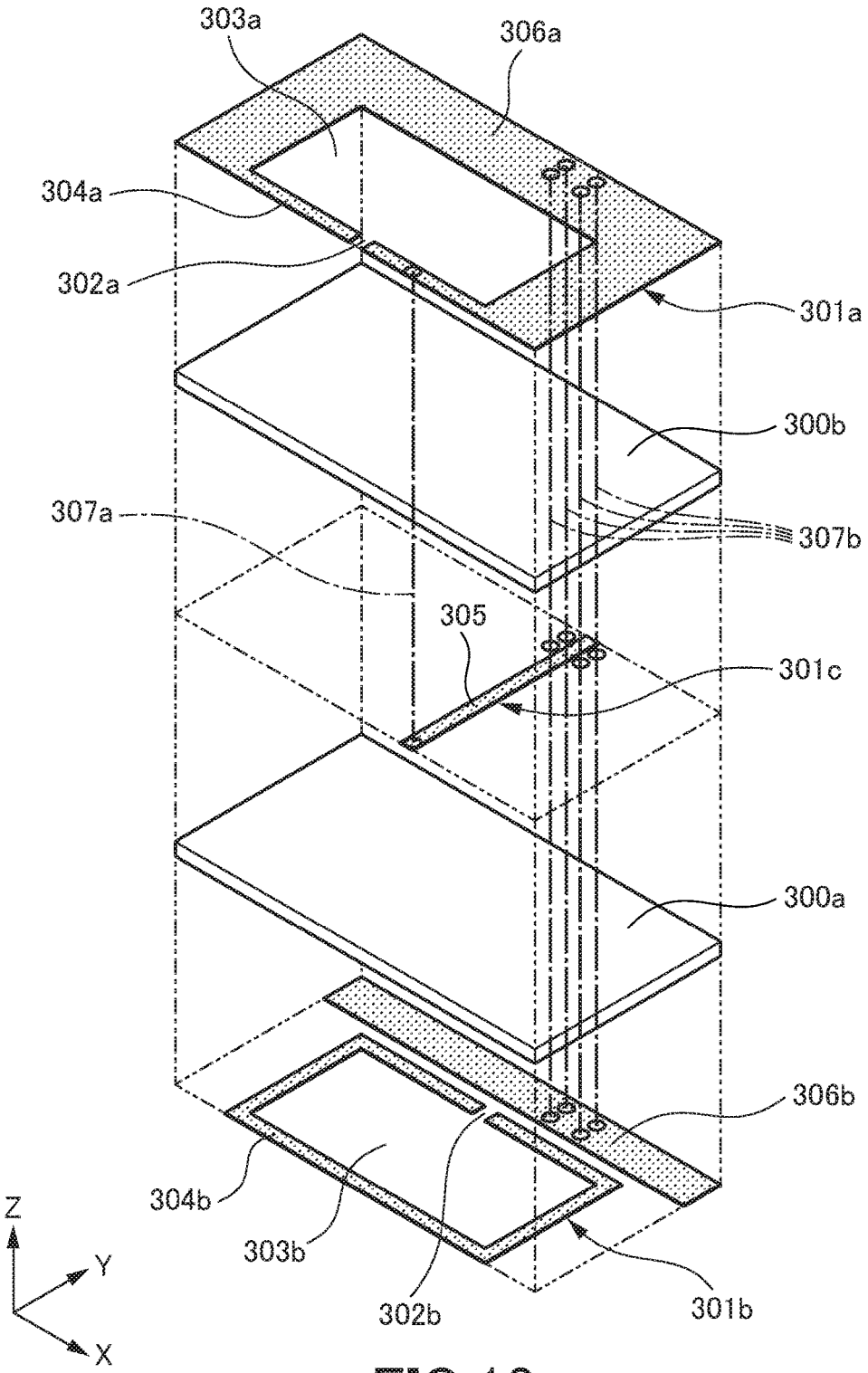
FIG. 18 is a diagram illustrating a fifth modified example of the antenna device according to the third embodiment.

FIG. 18 is a schematic configuration diagram of an antenna device according to a fifth modified example. The antenna device according to the fifth modified example is an antenna device in which the grounds 306*a* and 306*b* are electrically connected with the columnar conductor 307*a* and a plurality of columnar conductors 307*b* in the third modified example in FIG. 16 described above. Further, a coaxial line is used as the power supply line 305. The coaxial line (power supply line) is enclosed with the plurality of columnar conductors 307*b*. By using the coaxial line, it is possible to suppress unnecessary emission of an electromagnetic wave which propagates through the insulation layers 300*a* and 300*b*.

In the third embodiment and each modified example (FIG. 13A to FIG. 18), another insulation layer or another conductor layer may be further provided in an upward direction (the positive direction on the Z axis) or a downward direction (the negative direction on the Z axis) or in both directions. Further, the antenna device of the third embodiment and each modified example may be realized with only three layers of a four-layered substrate. As long as contradiction does not occur, the third embodiment may be modified in a similar manner to the first embodiment and the second embodiment.

Fourth Embodiment

Figure 19A:
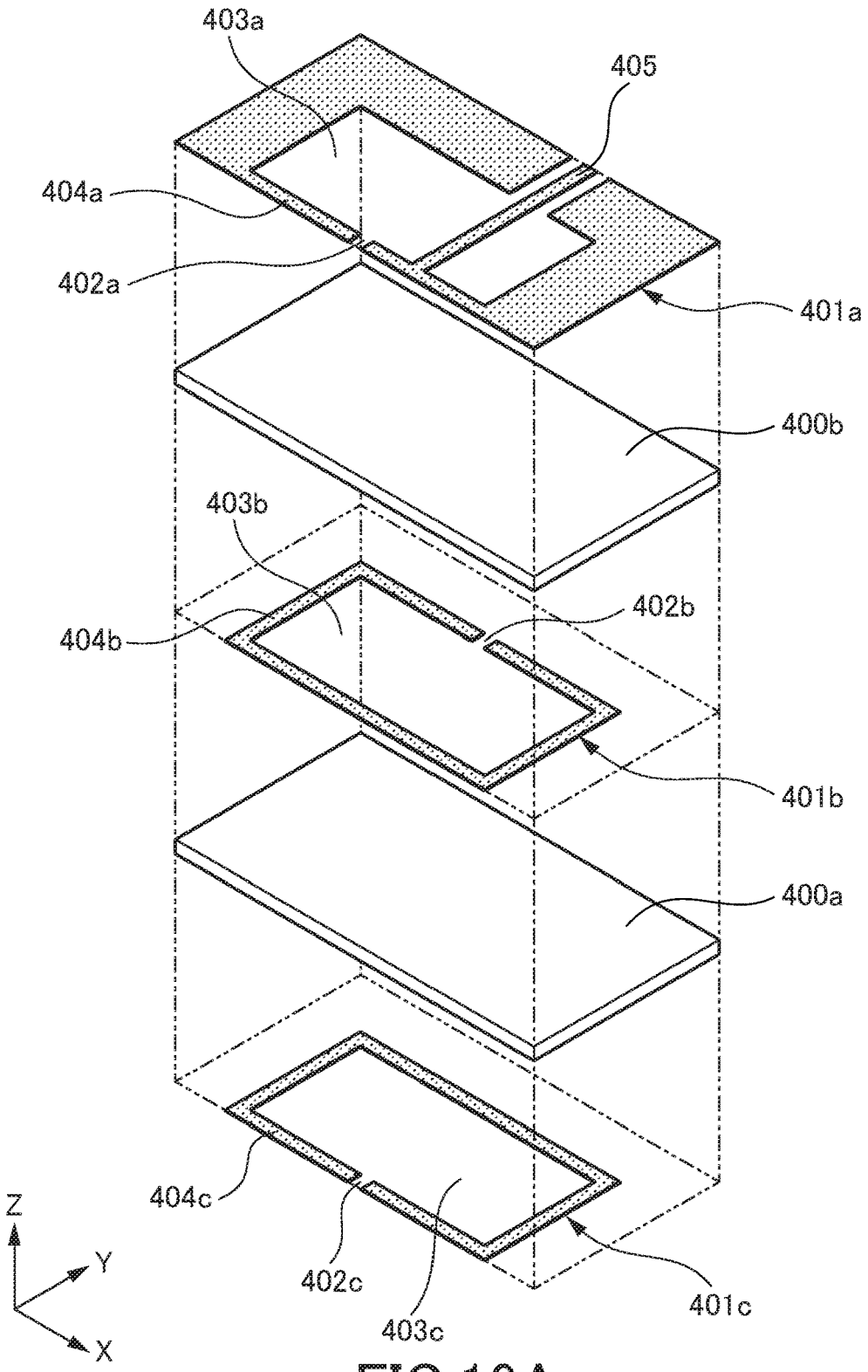
FIG. 19A is a diagram illustrating a schematic configuration of an antenna device according to a fourth embodiment.
Figure 19B:
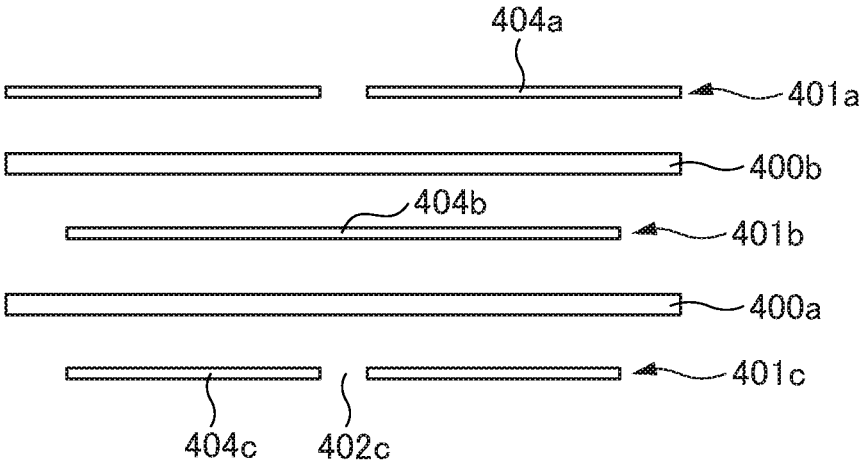
FIG. 19B is a side view of the antenna device in FIG. 19A.
Figure 19C:
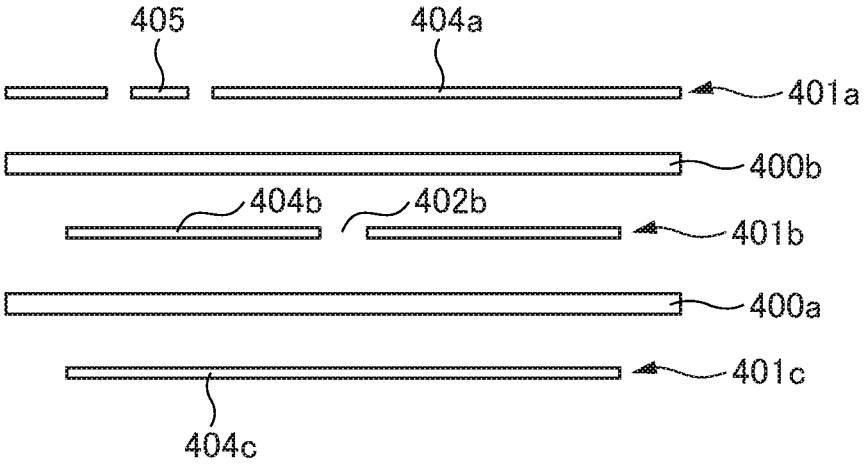
FIG. 19C is a side view of the antenna device in FIG. 19A.

FIG. 19A is a diagram illustrating an example of a schematic configuration of an antenna device according to a fourth embodiment of the present invention. FIG. 19B is a side view viewed from the negative direction on the Y axis, and FIG. 19C is a side view viewed from the positive direction on the Y axis. The fourth embodiment is based on the first to the third embodiments, and has characteristics that there are three or more conductor layers and three or more SRRs. One or less SRR is disposed on one conductor layer (in the case where there are four or more conductor layers, there may exist a conductor layer on which an SRR does not exist).

The antenna device in FIG. 19A corresponds to an antenna device in which a third conductor layer 401*c* is disposed below (in the negative direction on the Z axis of) the configuration in FIG. 4A according to the first embodiment with an insulation layer 400*a* in between. More specifically, the third conductor layer 401*c* is disposed below a second conductor layer 401*b* with the insulation layer 400*a* in between. As another configuration example, the third conductor layer may be disposed over (in the positive direction on the Z axis of) a first conductor layer 401*a* with an insulation layer in between.

The third conductor layer 401*c* includes an SRR 404*c*. The SRR 404*c* is a conductor which encloses an opening 403*c* and in which a void 402*c* separating a part of the conductor in a direction enclosing the opening 403*c* is formed. The SRR 404*c* is opposed to an SRR 404*b* via the insulation layer 400*a* in between. The SRR 404*c* is electrically separated from the SRR 404*b* and an SRR 404*a*.

The void 402*c* of the third conductor layer 401*c* does not overlap with a void 402*b* of the second conductor layer 401*b* when viewed from the Z axis direction. Therefore, for a reason similar to that described in the first embodiment, it is possible to obtain an effect of increasing the capacitance of the capacity between the second conductor layer 401*b* and the third conductor layer 401*c*. Because a void 402*a* and the void 402*b* do not overlap with each other, it is possible to obtain an effect of increasing the capacitance of the capacity between the first conductor layer 401*a* and the second conductor layer 401*b*.

However, the void 402*c* of the third conductor layer 401*c* may overlap with the void 402*b* of the second conductor layer 401*b* (that is, any positional relationship may be employed as positional relationship between the voids 402*b* and 402*c*). Even if the void 402*c* of the third conductor layer 401*c* and the void 402*b* of the second conductor layer 401*b* overlap with each other, because the void 402*a* of the first conductor layer 401*a* and the void 402*b* of the second conductor layer 401*b* do not overlap with each other, it is possible to obtain an effect of making the antenna device smaller as in the case with the first embodiment.

When the number of SRRs electrically separated from each other increases in this manner, because the capacitance between the SRRs increases, it is possible to further lower the resonant frequency.

Modified examples of the fourth embodiment will be described below.

Figure 20:
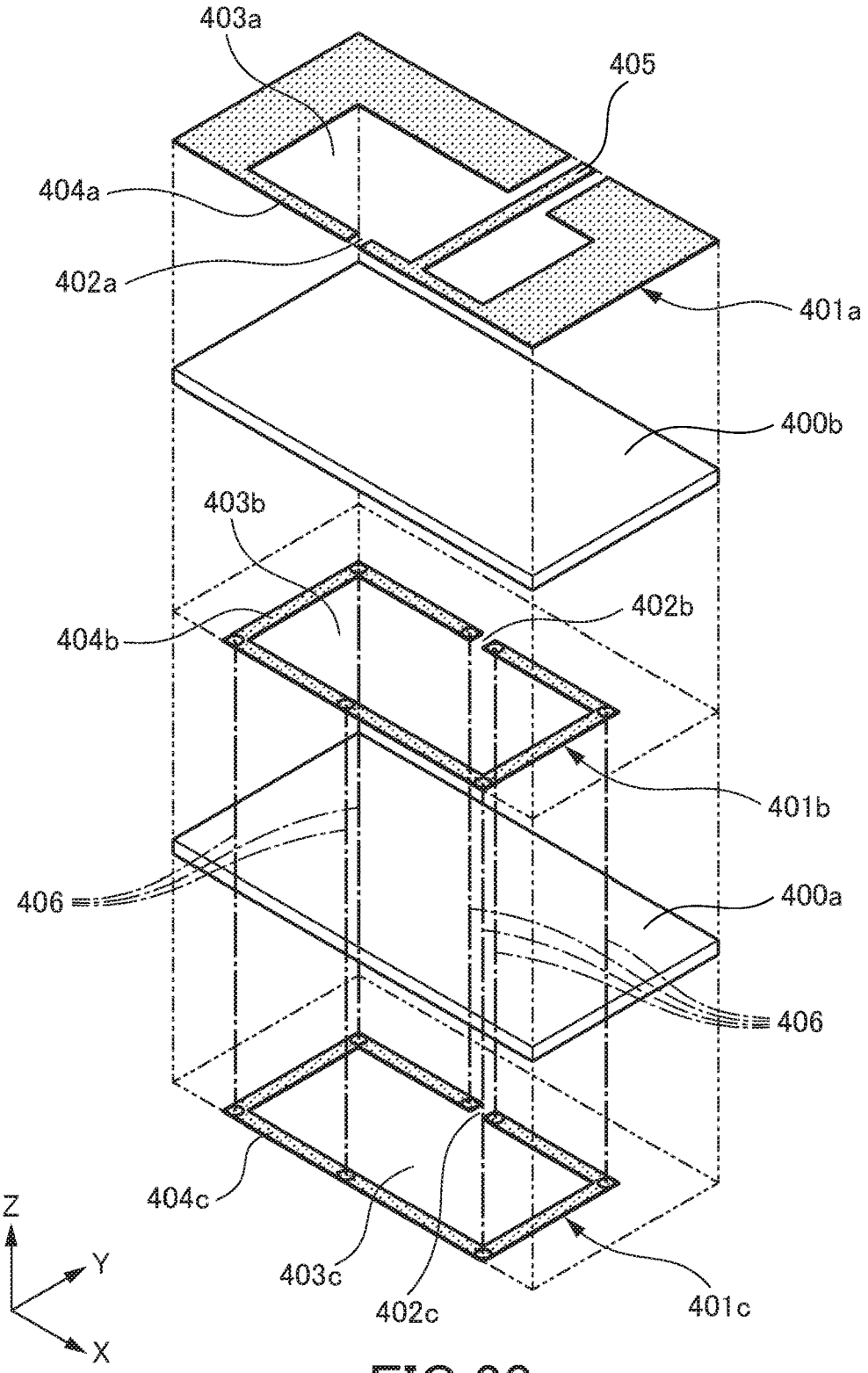
FIG. 20 is a diagram illustrating a first modified example of the antenna device according to the fourth embodiment.

FIG. 20 is a schematic configuration diagram of an antenna device according to a first modified example. The SRRs 404*b* and 404*c* of the second conductor layer 401*b* and the third conductor layer 401*c* are electrically connected by a plurality of columnar conductors 406 along the direction enclosing the opening. However, it is assumed that conductor portions which are opposed to each other via the void 402*b* in between are not short-circuited, and conductor portions which are opposed to each other via the void 402*c* in between are not short-circuited. The void 402*b* and the void 402*c* overlap with each other when viewed from the Z axis direction. While, when the SRRs 404*b* and 404*c* are electrically connected, the capacitance between the SRRs 404*b* and 404*c* is lost, even if a thickness of the insulation layer 400*a* between the second conductor layer 401*b* and the third conductor layer 401*c* changes, there is little change in the resonant frequencies of the antennas (SRRs 404*b* and 404*c*) (the resonant frequencies become stable).

There is a case where a ratio of dimension tolerance of a thickness of the insulation layer is large in such as a substrate in which the insulation layer is thin, for example. Further, the thickness of the insulation layer largely changes by temperature change according to types of the insulation layer (for example, in the case of Teflon, or the like). Because the capacitance between the SRRs depends on the thickness of the insulation layer, in the case where the SRRs disposed over and below the insulation layer are not electrically connected, the resonant frequency of the antenna sensitively changes by variation of the thickness of the insulation layer.

Because the SRRs 404*b* and 404*c* are electrically connected in the configuration in FIG. 20, the resonant frequencies of the SRRs 404*b* and 404*c* become stable, and the antenna stably operates at a desired frequency even if the thickness of the insulation layer changes. Further, because it is possible to reduce a dielectric loss due to the insulation layer 400*a*, efficiency of the antennas is improved. Note that, because the SRRs 404*a* and 404*b* are not electrically connected, the antenna device of the present modified example can provide an effect of making the antenna device smaller as in the case with the above-described embodiments.

Figure 21:
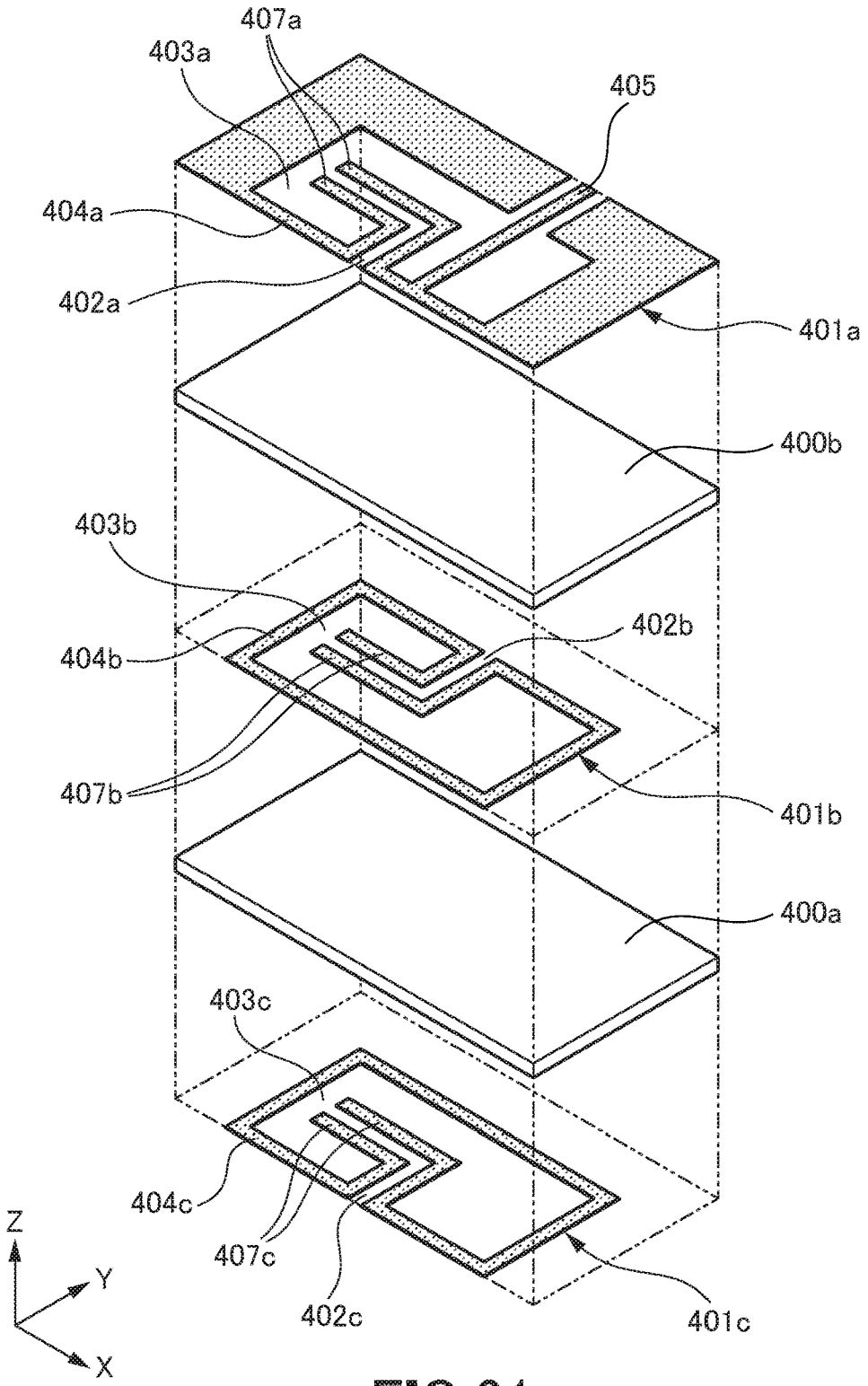
FIG. 21 is a diagram illustrating a second modified example of the antenna device according to the fourth embodiment.

FIG. 21 is a schematic configuration diagram of an antenna device according to a second modified example. The position of the void 402*c* is opposite from the position in FIG. 20. Further, belt-like conductors 407*a* which are parallel to each other are connected to conductor portions which are opposed to each other via the void 402*a* in between, belt-like conductors 407*b* which are parallel to each other are connected to conductor portions which are opposed to each other via the void 402*b* in between, and belt-like conductors 407*c* which are parallel to each other are connected to conductor portions which are opposed to each other via the void 402*c* in between. By adding the belt-like conductors in this manner, the capacitance of each SRR increases, and the resonant frequency becomes low.

While, in the example in FIG. 21, the belt-like conductors 407*a*, 407*b* and 407*c* are respectively added to all of the first conductor layer 401*a*, the second conductor layer 401*b* and the third conductor layer 401*c*, a belt-like conductor may be added to part of the conductor layers, for example, only the third conductor layer 401*c*.

While, in the example in FIG. 21, the power supply line 405 is provided on the first conductor layer 401*a*, the power supply line may be provided on another conductor layer. For example, in a four-layered substrate, SRRs may be provided on a first conductor layer, a second conductor layer and a fourth conductor layer, and a power supply line may be provided on a third conductor layer. As long as contradiction does not occur, the antenna device may be modified in a similar manner to the first to the third embodiments.

Fifth Embodiment

Figure 22:
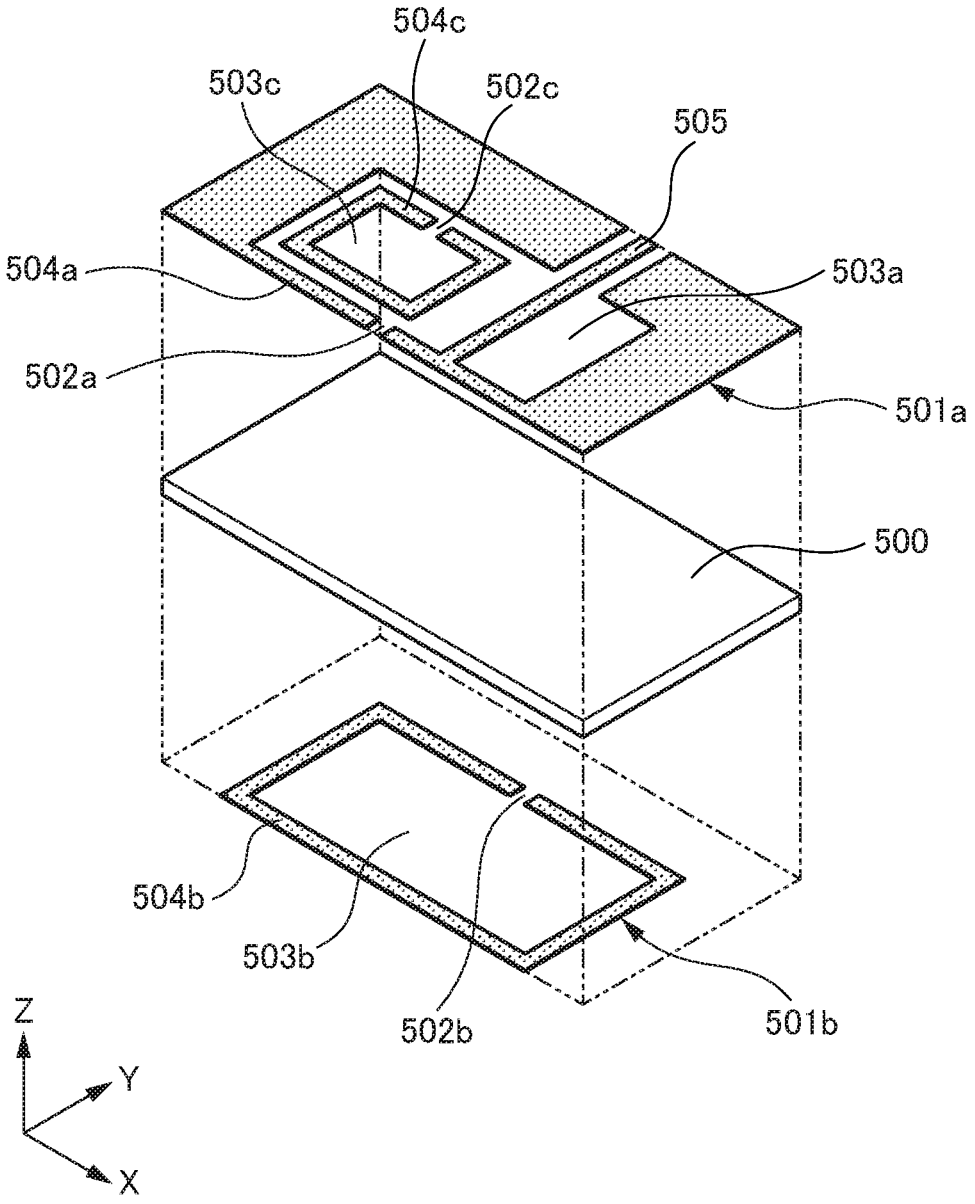
FIG. 22 is a diagram illustrating a schematic configuration of an antenna device according to a fifth embodiment.

FIG. 22 is a diagram illustrating an example of a schematic configuration of an antenna device according to a fifth embodiment of the present invention. The fifth embodiment is based on the first to the fourth embodiments, and has characteristics that at least one conductor layer includes a plurality of SRRs which are not electrically connected to each other.

The antenna device in FIG. 22 corresponds to an antenna device in which an SRR is newly added to inside of the opening of the first conductor layer of the antenna device in FIG. 4 according to the first embodiment. More specifically, as illustrated in FIG. 22, an SRR 504*c* is added to inside of an opening 503*a* of a first conductor layer 501*a*. The SRR 504*c* is a conductor which encloses an opening 503*c* and which includes a void 502*c* separating a part of the conductor in a direction enclosing the opening 503*c*. The SRR 504*c* is disposed at the same position as an SRR 504*a* when viewed from a direction (the X axis direction or the Y axis direction) orthogonal to a direction (the Z axis direction) that the SRR 504*a* and an SRR 504*b* are opposed to each other. In this manner, the first conductor layer 501*a* includes two SRRs 504*a* and 504*c*. These SRRs are not electrically connected. By a plurality of SRRs which are not electrically connected being disposed on the same conductor layer, capacitance occurs among the plurality of SRRs. It is possible to lower the resonant frequencies of these SRRs by this capacitance.

Figure 23:
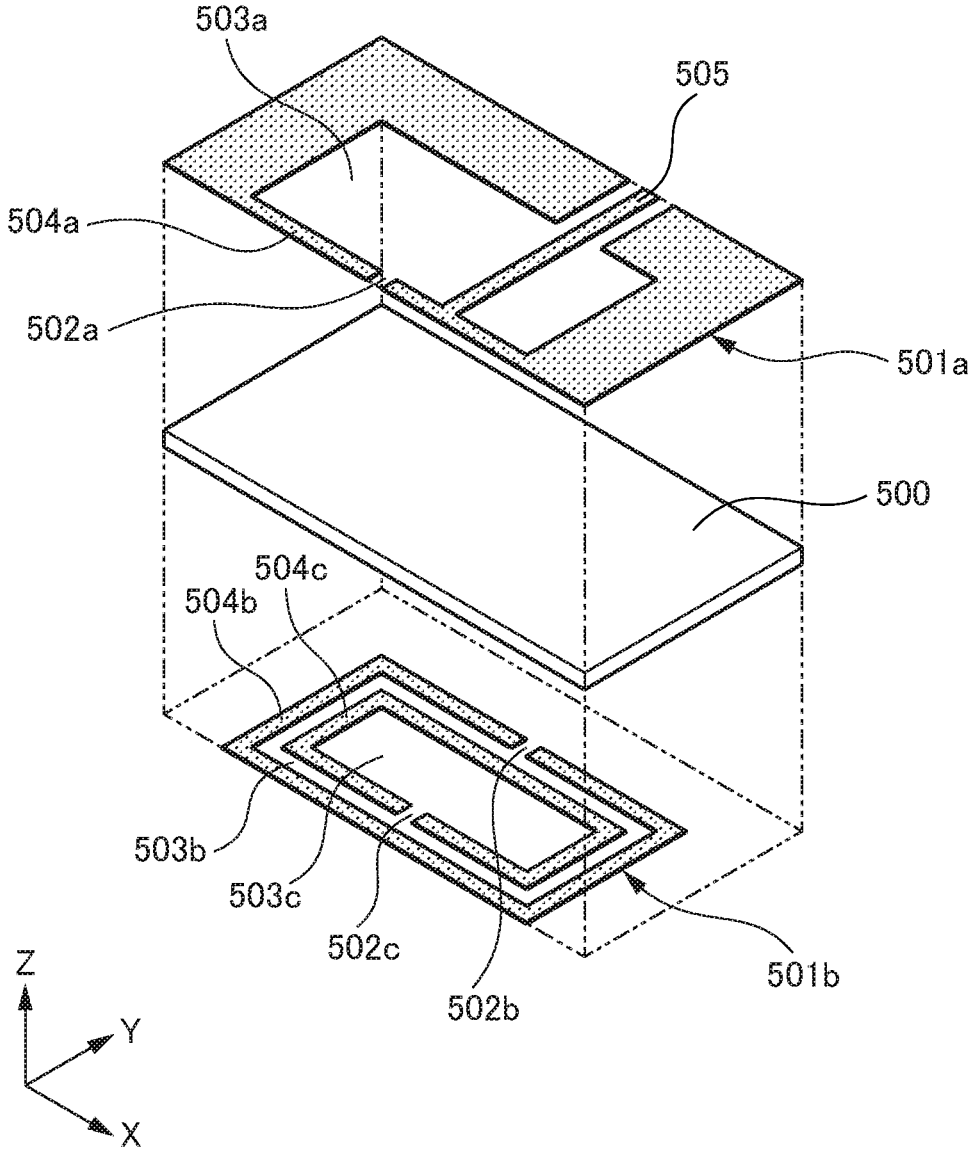
FIG. 23 is a diagram illustrating a first modified example of the antenna device according to the fifth embodiment.

FIG. 23 is a schematic configuration diagram of an antenna device according to a first modified example. In this example, a plurality of SRRs are provided not on the first conductor layer 501*a* but on a second conductor layer 501*b*. The SRR 504*c* is added to inside of an opening 503*b* of the second conductor layer 501*b*. Therefore, the second conductor layer 501*b* includes two SRRs 504*b* and 504*c*. These SRRs are not electrically connected. Also by this means, it is possible to obtain a similar effect to that obtained from the configuration in FIG. 22.

Figure 24:
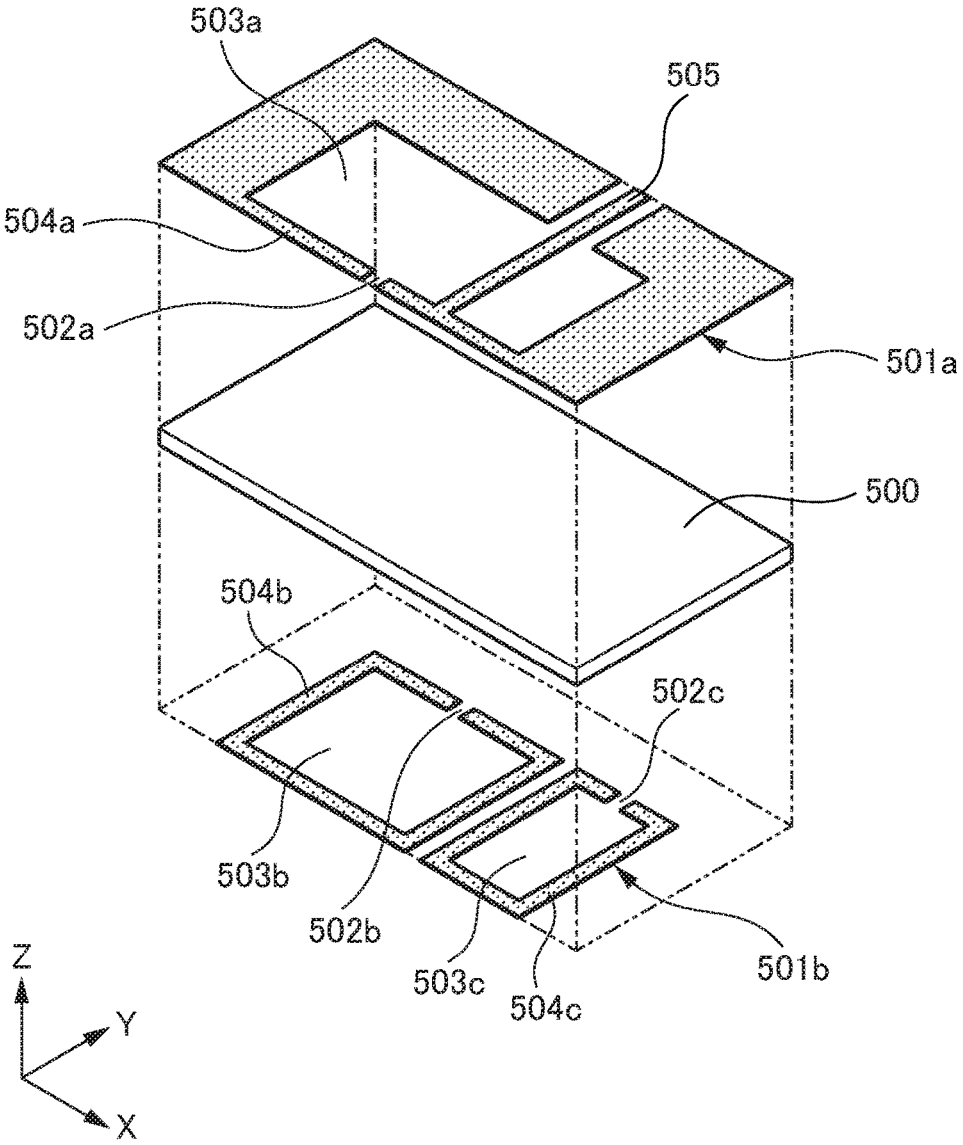
FIG. 24 is a diagram illustrating a second modified example of the antenna device according to the fifth embodiment.

FIG. 24 is a schematic configuration diagram of an antenna device according to a second modified example. A point different from FIG. 23 is that the SRR 504*c* is provided not inside, but outside the opening 503*b* of the SRR 504*b*. Other configurations are similar to those in FIG. 23.

As long as contradiction does not occur, it is possible to modify the fifth embodiment in a similar manner to the first to the fourth embodiments. For example, a plurality of SRRs may be formed on at least one conductor layer among first to n-th (where n is an integer equal to or greater than three) conductor layers.

Sixth Embodiment

Figure 25:
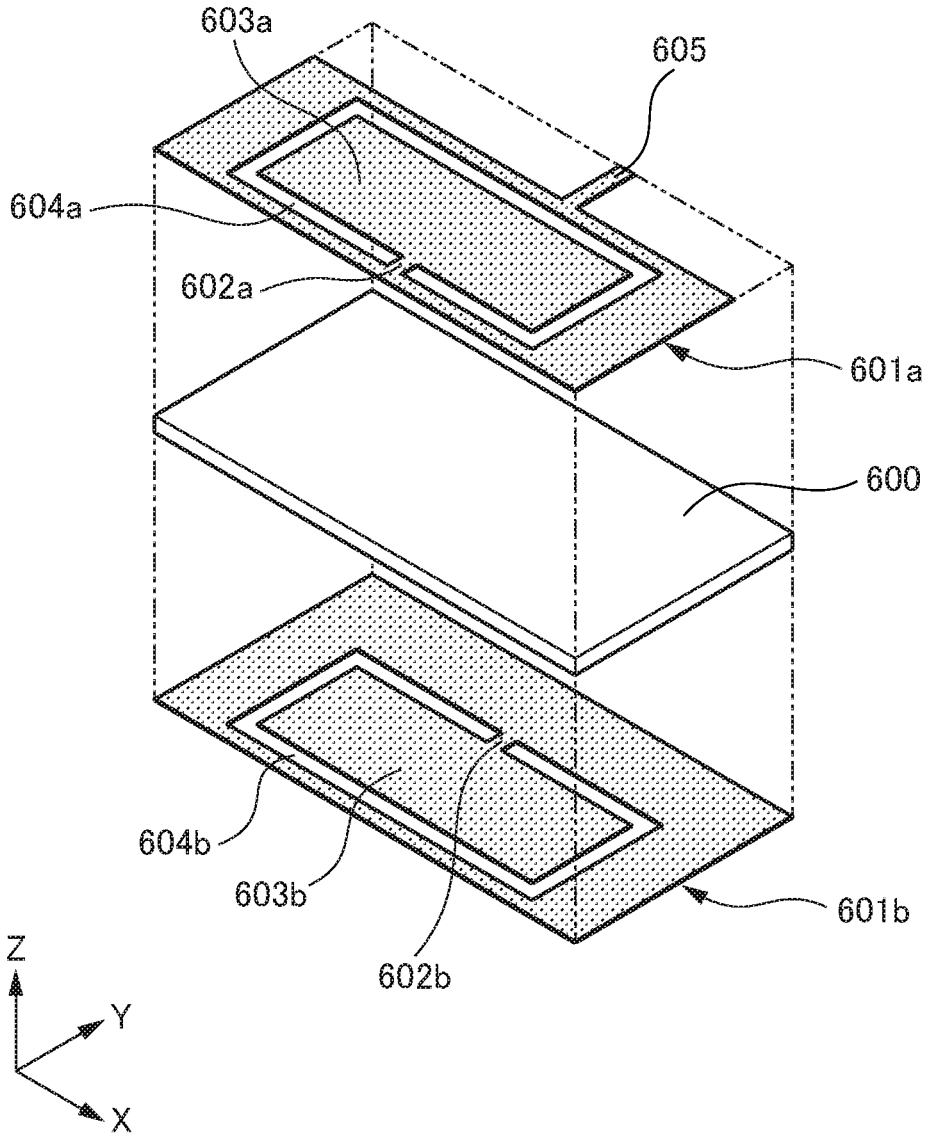
FIG. 25 is a diagram illustrating a schematic configuration of an antenna device according to a sixth embodiment.

FIG. 25 is a diagram illustrating an example of a schematic configuration of an antenna device according to a sixth embodiment of the present invention. While the sixth embodiment is based on the first to the fifth embodiments, the sixth embodiment is different from the first to the fifth embodiments in a structure of the SRR. That is, the SRR of the sixth embodiment is configured with a slit formed on the conductor layer.

An SRR 604*a* is formed on a first conductor layer 601*a*. The SRR 604*a* is an opening pattern (slit) which encloses a conductor portion 603*a* and whose both ends are separated from each other in a direction enclosing the conductor portion 603*a*. Both ends are opposed to each other. The conductor portion 603*a* and a conductor portion outside the slit are coupled with a conductor portion (coupling portion) 602*a* between both ends of the slit which are opposed to each other.

Further, an SRR 604*b* is formed on a second conductor layer 601*b*. The SRR 604*b* is an opening pattern (slit) which encloses a conductor portion 603*b* and whose both ends are separated from each other in a direction enclosing the conductor portion 603*b*. The conductor portion 603*b* and a conductor portion outside the slit are coupled with a conductor portion (coupling portion) 602*b* between ends of the slit which are opposed to each other.

The coupling portion 602*a* of the first conductor layer 601*a* and the coupling portion 602*b* of the second conductor layer 601*b* do not overlap with each other when viewed from the Z axis direction. That is, a region where the coupling portion 602*a* is projected in the negative direction on the Z axis does not overlap with the coupling portion 602*b*. In the illustrated example, the coupling portion 602*a* and the coupling portion 602*b* are located at opposite sides from each other when viewed from the Z axis direction.

The first conductor layer 601*a* includes a power supply line 605. The power supply line 605 is electrically connected to the conductor portion 603*a* of the first conductor layer 601*a*. The power supply line 605 is disposed so as not to separate the slit 604*a* because, while a magnetic current along the slit is generated in the SRRs 604*a* and 604*b*, if the power supply line 605 separates the slit 604*a*, the magnetic current is separated, and the SRRs do not resonate.

The SRR of the sixth embodiment has a configuration where the conductor of the SRR in the first to the fifth embodiments and a region where there is no conductor are inverted. Because there is duality relationship in terms of an electromagnetic field (relationship where an electric field and a magnetic field are exchanged, and a current and a magnetic current are exchanged), even if the conductor and the region where there is no conductor are inverted in this manner, characteristics of the antenna such as a resonant frequency do not essentially change. Therefore, it is possible to realize similar operation to that in the first to the fifth embodiments, so that it is possible to realize a smaller antenna device.

Note that because the resonant frequency is determined according to the configuration of the SRR, it is not necessary to exchange the conductor of the power supply line with the region where there is no conductor.

Modified examples of the sixth embodiment will be described below.

Figure 26:
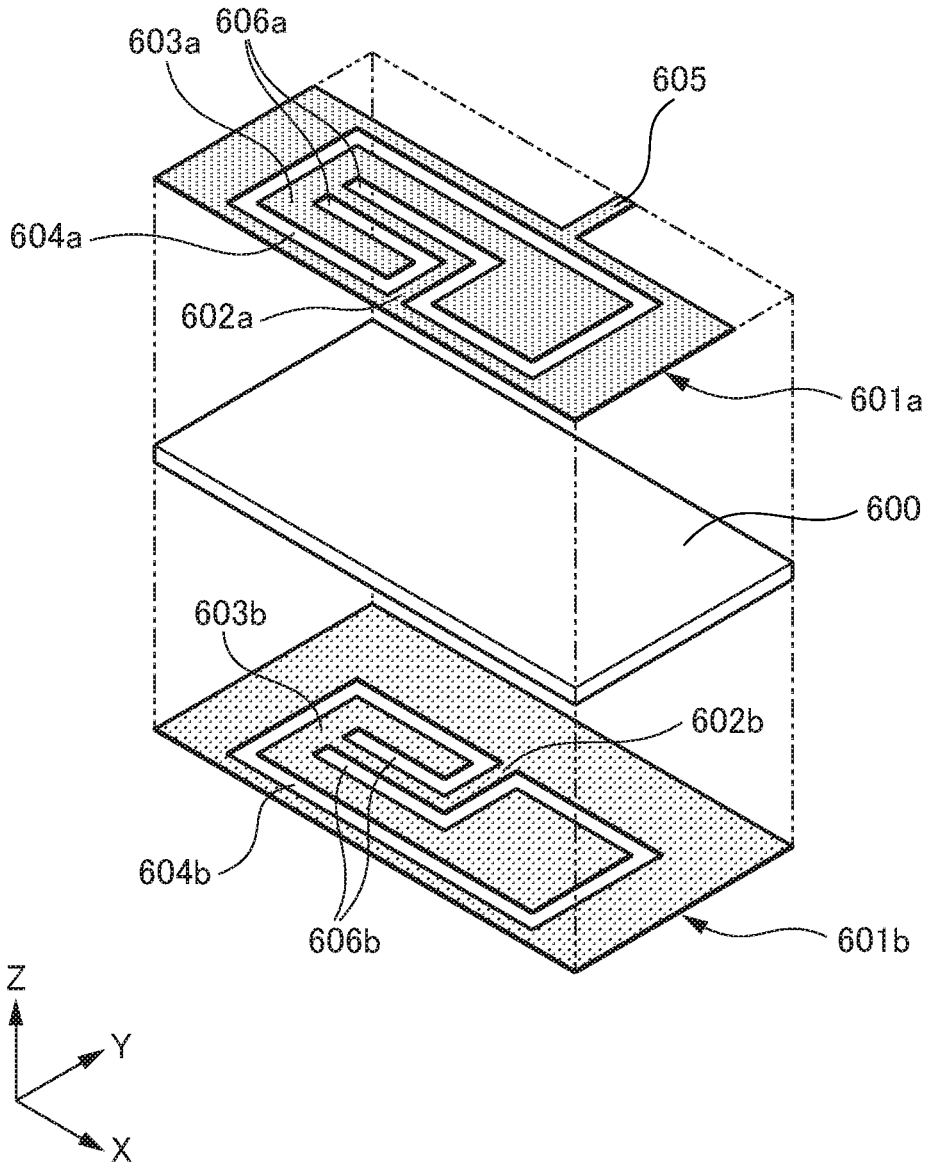
FIG. 26 is a diagram illustrating a first modified example of the antenna device according to the sixth embodiment.

FIG. 26 is a schematic configuration diagram of an antenna device according to a first modified example. Belt-like slits (opening patterns) 606*a* which are parallel to each other are coupled to both ends of the slit 604*a*. While, in the illustrated example, a width of the belt-like slit 606*a* is the same as that of the slit 604*a*, the width of the belt-like slit 606*a* may not be the same as that of the slit 604*a*. Further, while the belt-like slit 606*a* in FIG. 26 has an L shape, the belt-like slit 606*a* may have other shapes.

In a similar manner, belt-like slits (opening patterns) 606*b* which are parallel to each other are coupled to both ends of the slit 604*b*. While, in the illustrated example, a width of the belt-like slit 606*b* is the same as that of the slit 604*b*, the width of the belt-like slit 606*b* may not be the same as that of the slit 604*b*. Further, while the belt-like slit 606*b* in FIG. 26 has an L shape, the slit 606*b* may have other shapes.

The SRR in the present modified example has binary relationship in terms of an electromagnetic field with the SRR having the belt-like conductors in the first to the fifth embodiments.

According to the above-described configuration, as in the case with the antenna device having the SRR to which the belt-like conductors in the first to the fifth embodiments are connected, it is possible to lower the resonant frequency without making the antenna device larger.

Figure 27:
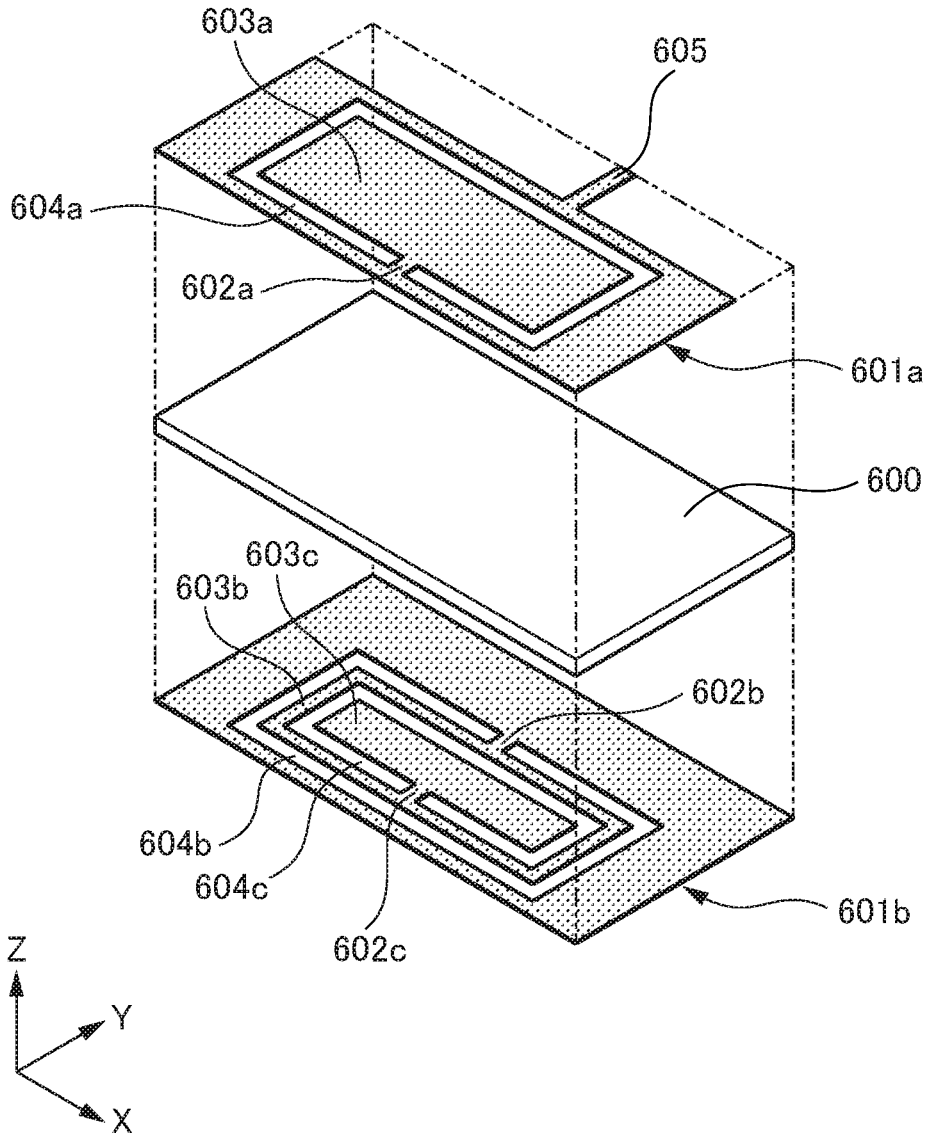
FIG. 27 is a diagram illustrating a second modified example of the antenna device according to the sixth embodiment.

FIG. 27 is a schematic configuration diagram of an antenna device according to a second modified example. The SRR 604*b* and an SRR 604*c* are formed on the second conductor layer 601*b*. The SRR 604*c* is a slit (opening pattern) which encloses a conductor portion 603*c* and whose both ends is separated from each other via a conductor portion 602*c* continuous from the conductor portion 603*c*. Both ends are opposed to each other. By forming a plurality of SRRs by a slit on the same conductor layer, as in the case with a case where a plurality of SRRs are formed in the first to the fifth embodiments, it is possible to obtain an effect of lowering the resonant frequency and an effect of multi-resonance.

As long as contradiction does not occur, it is possible to modify the sixth embodiment in a similar manner to the first to the fifth embodiments.

For example, the power supply line 605 may be provided at a position different from the positions of the SRR 604*a* and SRR 604*b* along a direction in which the SRR 604*a* is opposed to the SRR 604*b* (the Z axis direction). Specifically, the power supply line may be disposed at a position separated from the first conductor layer 601*a* in the positive direction on the Z axis or a position separated from the second conductor layer 601*b* in the negative direction on the Z axis. Alternatively, a third conductor layer may be disposed between the first conductor layer 601*a* and the second conductor layer 601*b*, and the power supply line may be disposed on the third conductor layer.

Further, in addition to the first conductor layer 601*a* and the second conductor layer 601*b*, the third to the n-th conductor layers may be disposed, and an SRR or SRRs may be formed by a slit or slits on at least one or all of the third to the n-th conductor layers. Still further, arbitrary two or more of the first to the n-th conductor layers may be electrically connected through a conductor. At this time, conductor portions between both ends of slits on arbitrary two conductor layers which are opposed to each other among conductor layers other than the two or more conductor layers do not overlap with each other when viewed from the Z axis direction.

It is also possible to modify the sixth embodiment in a way other than the modified examples described above as in the case with the first to the fifth embodiments and each modified example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions.

The invention claimed is:

1. An antenna device comprising:

a first split ring resonator including a conductor which encloses a first opening and has a first void separating a part of the conductor;

a second split ring resonator opposed to the first split ring resonator, including a conductor which encloses a second opening and has a second void separating a part of the conductor; and a power supply line configured to feed power to the first split ring resonator or the second split ring resonator, wherein the first split ring resonator is not electrically connected to the second split ring resonator, and the first void does not overlap with the second void in an opposing direction of the first split ring resonator and the second split ring resonator.

2. The antenna device according to claim 1, wherein the first void and the second void are located at opposite sides from each other in a view from the opposing direction of the first split ring resonator and the second split ring resonator.

3. The antenna device according to claim 1, wherein the first split ring resonator includes belt-like conductors which are respectively connected to conductor portions opposed to each other via the first void in the conductor, the belt-like conductors being parallel to each other, or the second split ring resonator includes belt-like conductors which are respectively connected to portions opposed to each other via the second void in the conductor, the belt-like conductors being parallel to each other.

4. The antenna device according to claim 1, wherein the power supply line is provided at a position different from the first split ring resonator and the second split ring resonator along the opposing direction of the first split ring resonator and the second split ring resonator.

5. The antenna device according to claim 1, further comprising:

third to n-th split ring resonators including conductors which enclose third to n-th openings and have third to n-th voids separating parts of the conductors where the n is an integer equal to or greater than three, wherein the first to the n-th split ring resonators are provided at different positions along the opposing direction of the first split ring resonator and the second split ring resonator.

6. The antenna device according to claim 5, wherein arbitrary two or more of the first to the n-th split ring resonators are electrically connected through a conductor, and the voids of arbitrary two opposing split ring resonators among split ring resonators other than the two or more split ring resonators connected through the conductor do not overlap with each other.

7. The antenna device according to claim 5, further comprising:

another split ring resonator disposed at same position as at least one of the first to the n-th split ring resonators in a direction orthogonal to the opposing direction of the first split ring resonator and the second split ring resonator.

8. The antenna device according to claim 1, further comprising:

another split ring resonator disposed at same position as the first split ring resonator or the second split ring resonator in a direction orthogonal to the opposing direction of the first split ring resonator and the second split ring resonator.

9. An antenna device comprising:

a first split ring resonator having a first slit which is formed on a first conductor layer, which encloses a first conductor portion, ends of the first slit being separated from each other;

a second split ring resonator having a second slit which is formed on a second conductor layer opposed to the first conductor layer, which encloses a second conductor portion, ends of the second slit being separated from each other; and a power supply line electrically connected to the first conductor layer or the second conductor layer, wherein the first conductor layer is not electrically connected to the second conductor layer, and the conductor portion between the ends of the first slit does not overlap with the conductor portion between the ends of the second slit in an opposing direction of the first split ring resonator and the second split ring resonator.

10. The antenna device according to claim 9, wherein the conductor portion between the ends of the first slit and the conductor portion between the ends of the second slit are located at opposite sides from each other in the opposing direction.

11. The antenna device according to claim 9, wherein the first split ring resonator includes belt-like slits which are respectively coupled to the ends of the first slit and which are parallel to each other, or the second split ring resonator includes belt-like slits which are respectively coupled to the ends of the second slit and which are parallel to each other.

12. The antenna device according to claim 9, wherein the power supply line is provided at a position different from the first split ring resonator and the second split ring resonator along the opposing direction of the first split ring resonator and the second split ring resonator.

13. The antenna device according to claim 9, further comprising:

third to n-th split ring resonators having third to n-th slits which are formed on third to n-th conductor layers, which enclose third to n-th conductor portions and whose ends are opposed to each other, where n is an integer equal to or greater than three.

14. The antenna device according to claim 13, wherein arbitrary two or more of the first to the n-th conductor layers are electrically connected through a conductor, and the conductor portions between the slits on two arbitrary opposing conductor layers other than the two or more conductor layers do not overlap with each other in an opposing direction of the two conductor layers.

15. The antenna device according to claim 13, further comprising:

another split ring resonator having a slit formed on at least one of the first to the n-th conductor layers, which encloses a conductor portion and whose ends are separated from each other.

16. The antenna device according to claim 9, further comprising:

another split ring resonator having a slit which is formed on the first conductor layer or the second conductor layer, which encloses a conductor portion and whose ends are separated from each other.

* * * * *